US006075213A

United States Patent [19]

Ichiro

[11] Patent Number: 6,075,213

[45] Date of Patent: Jun. 13, 2000

[54] DRIVE UNIT STRUCTURE FOR KEYBOARD ASSEMBLIES

[75] Inventor: Osuga Ichiro, Hamamatsu, Japan

[73] Assignee: Yamaha Corporation, Hamamatsu, Japan

[21] Appl. No.: 09/238,644

[22] Filed: Jan. 26, 1999

[30] Foreign Application Priority Data

Jan. 28, 1998 [JP] Japan ..... 10-029028
Jan. 28, 1998 [JP] Japan ..... 10-030526

[51] Int. Cl.[7] ..... H01H 13/70

[52] U.S. Cl. ..... 200/1 B; 200/5 A; 200/517; 200/343

[58] Field of Search ..... 84/719, 744, 326; 200/1 B, 5 A, 6 R, 16 R, 517, 341–345; 341/22, 168; 364/189, 709, 12; 400/472, 480, 481, 490, 491, 491.2, 495, 495.1, 496; 463/37

[56] References Cited

U.S. PATENT DOCUMENTS 4,480,162 10/1984 Greenwood ..... 200/181
4,613,737 9/1986 Nishijima ..... 200/340
5,062,342 11/1991 Nagatsuma ..... 84/744
5,481,074 1/1996 English ..... 200/5 A
5,505,115 4/1996 Vandervoort ..... 84/423 R

FOREIGN PATENT DOCUMENTS 5-127664 5/1993 Japan ..... G10B 3/12
8-44360 2/1996 Japan ..... G10H 1/34
8-44361 2/1996 Japan ..... G10H 1/34

OTHER PUBLICATIONS

AR Journal of Technical Disclosure, Disclosure No. 87–15816, Dec. 21, 1987.

AS Journal of Technical Disclosure, Disclosure No. 88–3914, Apr. 20, 1988.

*Primary Examiner*—Michael Friedhofer
*Attorney, Agent, or Firm*—Graham & James LLP

[57] ABSTRACT

A drive unit structure for a keyboard assembly is provided, which comprises a driven member having a flat sliding surface and pivotable about a fulcrum thereof, and an actuator disposed for sliding contact with the flat sliding surface of the driven member to pivotally drive the driven member. The fulcrum of the driven member lies in a plane including the flat sliding surface of the driven member. As a result, the operations of the actuator and driven member can be stable, to thereby enhance the accuracy of transmission of the operation of the actuator to the driven member.

21 Claims, 20 Drawing Sheets

DRIVE UNIT STRUCTURE FOR KEYBOARD ASSEMBLIES

BACKGROUND OF THE INVENTION

1. Field of the Invention

This invention relates to a drive unit structure for keyboard assemblies, and more particularly to a drive unit structure for a keyboard assembly, which is comprised of a driving member and a driven member.

2. Prior Art

A conventional keyboard assembly for use in electronic keyboard musical instruments in general is provided with various drive units formed of driving members (actuators) and driven members driven by the driving members or actuators. For example, a drive unit structure for a keyboard assembly of this kind is generally known, which is comprised of a mass member associated with a key, for imparting inertia to an operation of depressing the key, a key switch driven by the mass member, for detecting the key depressing operation. The mass member is pivotally moved in response to the key depressing operation, and the key switch is driven through the pivotal movement of the mass member.

In the above driver mechanism, the key and the mass member forms a drive unit, wherein the key is an actuator and the mass member is a driven member, and the mass member and the key switch also form a drive unit, wherein the mass member is an actuator and the key switch is a driven member.

These drive units are generally constructed such that the actuator and the driven member (or the driven member alone) are each pivotally moved about a fulcrum thereof, and when the actuator is pivotally moved, a portion of the actuator contacts the driven member to cause pivotal movement of the same. Usually, at least one of the actuator and the driven member has a flat surface portion thereof adapted for contact with the other. More specifically, for example, a tip or free end portion of the actuator is shaped in the form of a curved surface, while a corresponding portion of the driven member is shaped in the form of a flat surface, and the curved surface of the actuator contacts the flat surface of the driven member so that the driven member is driven by the actuator.

In the conventional drive unit structure, however, the influence of friction between the actuator and the driven member occurring during driving operation of the actuator is not fully contemplated, and therefore, the conventional drive unit structure remains to be improved in stableness of driving operation.

More specifically, in the conventional drive unit structure, the axes of the fulcrum shafts of the actuator and the driven member are not in alignment with each other. Therefore, when the driven member is pivotally moved through the pivotal movement of the actuator, the two members necessarily slide against each other. Since the actuator thus drives the driven member while the former is in sliding contact with the latter, a frictional force is generated between the two members.

FIG. 1 shows an example of the conventional drive unit structure. In FIG. 1, reference numeral 101 designates an actuator which forms part of a key, for example. The actuator 101 has a convex protuberance 101*a* at its tip and is movable in vertical directions as viewed in the figure. Reference numeral 102 designates a driven member which is a mass member or a key switch. The driven member 102 has a flat sliding surface 102*a* and is pivotable about a fulcrum shaft thereof.

The protuberance 101*a* of the actuator 101 drives the driven member 102 in such a manner that the protuberance 101*a* slidingly urges the sliding surface 102*a* of the driven member 102. During this driving operation, the actuator 101 moves downward almost straight, and accordingly sliding occurs between the protuberance 101*a* and the sliding surface 102*a* in leftward and rightward directions as viewed in the figure so that a frictional force F is generated. The frictional force F acts upon the sliding surface 102*a* in the sliding direction, and therefore the moment of rotation M about the fulcrum shaft 103 is expressed as $M=F\times L$, where L represents the minimum distance between the axis of the fulcrum shaft 103 and a plane including the sliding surface 102*a*, which changes with the driving stroke of the actuator 101. In the illustrated example, the frictional force F acts upon the actuator 101 and the driven member 102, and the moment of rotation M acts upon the driven member 102. In an arrangement that the actuator 101 is pivotable about a fulcrum shaft thereof, the actuator 101 is also acted upon by the moment of rotation.

If the driven member is a mass member having large inertia or a switch whose switching operation directly affects the key depression accuracy, the frictional force F between the actuator and the driven member is so large that it cannot be ignored. Particularly, in the case where the actuator and the driven member are both rotatable members, the frictional force acts upon the actuator and the driven member as the moment of rotation, and appreciably affects the operation of the drive unit if it is large in magnitude.

Further, at a time point of acceleration of the key such as an initial stage of depression of the key and an initial stage of return of the key from a lower limit position or at the termination of key depression stroke (so-called key flapping position at the end of key depression stroke), a particularly smooth and quick motion is required of the drive unit. Besides, a sensitive driving motion as intended is required of the drive unit for accurate detection of depression of the key. A large frictional force, however, badly affects the operation of the drive unit.

More specifically, in the conventional drive unit structure, the frictional force generated between the actuator and the driven member can make the operations of the actuator and the driven member unstable so that the operation of the actuator cannot be properly transmitted to the driven member. For example, if the drive unit performs key depressing operation, the key depression resistance increases, resulting in a degraded feeling of touch and degraded accuracy of detection of key depression.

The conventional electronic keyboard musical instruments provided with drive units formed of keys and key switches include a type which electrically reproduces sounds of acoustic musical instruments such as grand piano and pipe organ in response to key depressions detected by the key switches. The electronic keyboard musical instruments of this type include those which are adapted to have a key depression feeling close to that of a natural musical instrument. For example, a keyboard musical instrument is known which uses mass members to impart appropriate inertia to the key depressing operation to thereby obtain a key depression feeling close to that of a grand piano.

FIG. 2 is a graph showing key depression resistance obtained by the known keyboard musical instrument provided with a drive unit structure using mass members. In the figure, the ordinate represents a key position ST during key depression stroke, and the abscissa represents a load transmitted to the finger through the key (key depression resistance FK"). Symbol STO" on the abscissa indicates a key depression starting position (upper limit position or non-depressed position of the key), ST1" a position of the key (or the actuator, not shown) in which the key contacts the switch, and STF" a lower limit position of the key (after execution of the full stroke). In this electronic keyboard musical instrument, by virtue of a mass member, between key positions STO" and ST1', the key depression resistance FK" exhibits a close characteristic to that of a grand piano in general, particularly in the depressing stroke, thus obtaining a key depression feeling which is close to that of a genuine or natural grand piano to some degree.

It is, however, difficult to perfectly reproduce a key depression feeling of a genuine acoustic musical instrument. For example, in the case of a grand piano, the key depression resistance generally slowly progressively increases during key depression stroke and sharply rises near the lower limit position at the completion of the key depression, while intricately varying due to pivoting of a jack, a frictional force generated between the jack and its associated roller pad. The characteristic of change of the key depression resistance differs depending upon the kind of the musical instrument. It is not realistic to provide the electronic keyboard musical instrument with a key depressing mechanism similar or identical to that of a natural musical instrument to reproduce a key depression feeling of the same.

The key switches used in electronic keyboard musical instruments in general are formed of a resilient material such as rubber, and characteristics of the resilient material affects the key depression resistance.

FIGS. 3A and 3B are sectional fragmentary views showing a drive unit structure of a conventional keyboard assembly provided with key switches formed of a resilient material as mentioned above. FIG. 3A shows the drive unit structure at an initial stage of key depression stroke, and FIG. 3B shows the same at termination of the key depression stroke.

A switch 203 which is a driven member is formed of Ian elastic material such as a resilient resin, and has a swelled portion 203*a* which is pivotably supported on a fulcrum P3'. An actuator 202 which is a key driven through key depressing operation (or a member driven through a key) is pivotably supported on a fulcrum P2'. The actuator 202 is disposed in contact with the swelled portion 203*a* of the switch 203 at a point of contact Q' to urgingly drive the switch 203. The distance L1' between the fulcrum P2' and the point of contact Q' and the distance L2' between the fulcrum P3' and the point of contact Q' hardly vary during the time from the initial stage of key depression stroke (FIG. 3A) to the termination of the same (FIG. 3B).

When the switch 203 is driven, a skirt portion 203*aa* of the swelled portion 203*a* is deflected and hence the swelled portion 203*a* is buckled so that a pair of movable contacts SW' are brought into contact with respective fixed contacts FS', whereby a key depression is detected. On this occasion, a reaction force is generated in the swelled portion 203*a* as the swelled portion 203*a* is deflected. Since the distances L1' and L2' remain almost constant as mentioned above, the characteristic of change of the key depression resistance FK" depends upon the reaction force. Consequently, as shown in FIG. 2, the key depression resistance FK" once rises just after the key position ST1", drops just before the key position STF" as indicated by a circle Z, and sharply rises at the key position STF". That is, while the key depression resistance FK" is low, the key strikes on a lower stopper, not shown, for limiting a lower limit position at the end of key depression stroke, whereupon a vibration caused by the striking is transmitted to the finger through the drive unit. A feeling of touch based upon such a key depression resistance characteristic is different from a good feeling of touch inherent in a grand piano (a feeling that the key sticks to its lower limit position), and a player will have a degraded feeling of after touch in particular.

Thus, in electronic keyboard musical instruments, the key depression feeling, particularly the feeling of after touch depends upon characteristics of the material forming the switches such as buckling strength and reaction force, and therefore it is difficult to reproduce the real key depression feeling of an acoustic musical instrument. As noted above, in the illustrated drive unit formed of a key and a switch, the key depression feeling depends upon the key depression resistance during the characteristic of change of key depression stroke, i.e. key driving resistance that the key receives. Also in other drive units, it is desirable that the characteristic of change of the driving resistance can be freely set.

SUMMARY OF THE INVENTION

It is a first object of the invention to provide a drive unit structure for a keyboard assembly, which is capable of stabilizing the operations of an actuator and a driven member thereof to thereby enhance the accuracy of transmission of the operation of the actuator to the driven member.

It is a second object of the invention to provide a drive unit structure for a keyboard assembly, which is simple in construction but is capable of permitting free setting of the characteristic of change of the driving resistance.

To attain the first object, in a first aspect of the present invention, there is provided a drive unit structure for a keyboard assembly, comprising a driven member having a flat sliding surface and pivotable about a fulcrum thereof, and an actuator disposed for sliding contact with the flat sliding surface of the driven member to pivotally drive the driven member, wherein the fulcrum of the driven member lies in a plane including the flat sliding surface of the driven member.

According to the above arrangement, a frictional force generated by the sliding contact between the driven member and the actuator does not act as the moment of rotation about the fulcrum. Thus, no resisting force due to the moment of rotation does not act upon the element as the driven member. As a result, the operations of the actuator and driven member can be stable, to thereby enhance the accuracy of transmission of the operation of the actuator to the driven member. For example, if the drive unit structure according to the first aspect is applied to a drive unit including an actuator for a key, the feeling of touch can be improved due to reduced key depression resistance.

Preferably, the driven member comprises a mass member for imparting inertia to an operation of depressing the key, and the actuator comprises the key, whereby the feeling of touch can be improved, or the driven member comprises a key switch for detecting an operation of depressing the key, and the actuator comprises a mass member for imparting inertia to the operation of depressing the key, whereby the accuracy of detection of key depression as well as the feeling of touch can be improved.

To attain the first object, in a second aspect of the present invention, there is provided a drive unit structure for a keyboard assembly, comprising a driven member having a flat sliding surface and pivotable about a first fulcrum thereof, and an actuator pivotable about a second fulcrum thereof and disposed for sliding contact with the flat sliding surface of the driven member to pivotally drive the driven member about the first fulcrum, wherein a plane including the flat sliding surface of the driven member passes the second fulcrum during a stroke of pivotally driving the driven member by the actuator.

According to the above arrangement, when the plane including the sliding surface of the driven member passes the second fulcrum, a frictional force generated by the sliding contact between the driven member and the actuator does not act as the moment of rotation about the second fulcrum. Consequently, the resisting force against the driving operation of the actuator becomes the minimum. As a result, the operations of the actuator and driven member can be stable, to thereby enhance the accuracy of transmission of the operation of the actuator to the driven member. Further, if the drive unit structure according to the second aspect is applied to a drive unit including an actuator for a key, the feeling of touch can be improved due to reduced key depressing resistance.

Preferably, the drive unit structure according to the second aspect includes a key, and a switch board, and the actuator is disposed to pivotally move in response to an operation of depressing the key. The driven member comprises a key switch disposed for contact with the switch board to thereby detect the operation of depressing the key. A plane including the flat sliding surface of the driven member passes the second fulcrum when the key switch is in contact with the switch board.

According to the above arrangement, the resisting force against the driving operation of the actuator becomes the minimum when the key switch is in contact with the switch board. As a result, the operations of the actuator and driven member can be stable at the time of contacting of the key switch with the switch board which is the most important timing for detection of the key depressing operation, to thereby enhance the accuracy of detection of the key depressing operation.

Alternatively, the drive unit structure according to the second aspect includes a key, and the actuator is disposed to pivotally move in response to an operation of depressing the key. A plane including the flat sliding surface of the driven member passes the second fulcrum when the key reaches a lower limit position thereof at an end of a stroke of depressing the key.

According to the above arrangement, the resisting force against the driving operation of the actuator becomes the minimum when the key reaches the lower limit position thereof at the end of a stroke of depressing the key. As a result, the operations of the actuator and driven member can be stable at the time when the key reaches the lower limit position at the end of the stroke of depressing the key, which most affects the feeling of after touch, to thereby improve the feeling of touch.

To attain the first object, in a third aspect of the invention, there is provided a drive unit structure for a keyboard assembly, comprising a driven member having a flat sliding surface and pivotable about a first fulcrum thereof, and an actuator pivotable about a second fulcrum thereof and disposed for sliding contact with the flat sliding surface of the driven member to pivotally drive the driven member, wherein a point of contact at which the actuator contacts the driven member traverses a segment extending through the first fulcrum and the second fulcrum during a stroke of pivotally driving the driven member by the actuator.

According to the above arrangement, when the point of contact at which the actuator contacts the driven member traverses the segment extending through the first fulcrum and the second fulcrum, the first and second fulcrums and the point of contact lies in almost the same plane. Consequently, the amount of relative sliding of the actuator and the driven member can be reduced to the minimum and hence the frictional force is reduced to thereby reduce the resistance to the operations of the actuator and driven member. As a result, the operations of the actuator and driven member can be stable, to thereby enhance the accuracy of transmission of the operation of the actuator to the driven member. Also, if the arrangement is applied to a drive unit including an actuator for a key, the feeling of touch of the key can be improved due to reduced key depressing resistance. Further, the effective life of the drive unit can be prolonged.

Preferably, the drive unit structure according to the third aspect includes a key, and a switch board, and the actuator is disposed to pivotally move in response to an operation of depressing the key. The driven member comprises a key switch disposed for contact with the switch board to thereby detect the operation of depressing the key, and the point of contact at which the actuator contacts the driven member lies on the segment extending through the first fulcrum and the second fulcrum when the key switch is in contact with the switch board.

According to the above arrangement, the amount of sliding of the actuator on the driven member can be most reduced at the time of contacting of the key switch with the key board, which is the most important timing for detecting the key depressing operation, whereby the operations of the actuator and driven member can be stable, to thereby enhance the accuracy of detection of the key depressing operation.

Alternatively, the drive unit structure according to the third aspect includes a key, and the actuator is disposed to pivotally move in response to an operation of depressing the key. The point of contact at which the actuator contacts the driven member lies on the segment extending through the first fulcrum and the second fulcrum when the key reaches a lower limit position thereof at an end of a stroke of depressing the key.

According to this arrangement, the operations of the actuator and driven member can be stable at the time when the key reaches the lower limit position at the end of the stroke of depressing the key, which most affects the feeling of after touch, to thereby improve the feeling of touch.

Preferably, the point of contact at which the actuator contacts the driven member depicts a locus intersecting the segment extending through the first fulcrum and the second fulcrum.

In this arrangement, it is advantageous that the intersecting point of the locus depicted by the point of contact at which the actuator contacts the driven member and the segment lies between the first fulcrum and the second fulcrum. In this case, the movement of the point of contact on the sliding surface of the driven member takes places as follows: When the driven member pivotally moves in a direction in which the point of contact approaches the segment extending through the first and second fulcrums, the actuator slides toward the first fulcrum. On this occasion, a portion of the actuator (which has a convex section, for example) in contact with the sliding surface of the driven member rolls on the sliding surface of the driven member toward the first fulcrum. Thus, the rolling of the actuator causes a reduction in the amount of sliding of the actuator on the driven member. Consequently, the sliding distance can be shortened, and hence the sliding amount can be reduced at an initial stage of the forward operations of the actuator and driven member, to a smaller distance than at a terminating stage thereof. As a result, the key depressing resistance can be reduced at the initial stage of key depressing operation which is an important depression timing when the key is accelerated, whereby the operations of the actuator and driven member can be stable to improve the feeling of touch.

To attain the second object, in a fourth aspect of the invention, there is provided a drive unit structure for a keyboard assembly, comprising a driven member pivotable about a first fulcrum thereof, and an actuator pivotable about a second fulcrum thereof and having a surface thereof disposed for sliding contact with a surface of the driven member to pivotally drive the driven member, wherein one of the surface of the actuator and the surface of the driven member is shaped in the form of a convex, and the other of the surface of the actuator and the surface of the driven member has a curvature smaller than a minimum curvature of the one of the surface of the actuator and the surface of the driven member.

According to this arrangement, since one of the surfaces of the actuator and the driven member which are disposed for sliding contact with each other is shaped in the form of a convex, and the other has a curvature smaller than the minimum curvature of the one surface, the position of the point of contact between the one surface and the other surface can vary during a stroke of pivotal movement of the driven member. As a result, the moment of rotation generated by the actuator to drive the driven member can be changed.

By setting the curvatures of the two surfaces while satisfying the above conditions, the characteristic of change of the moment of rotation can be freely set as desired. As a result, the characteristic of change of the driving resistance can be freely set as desired with a simple structural means. If the drive unit structure according to the fourth aspect is applied to a drive unit associated with the key depressing operation, it is possible to obtain a key depression feeling very close to that of various keyboard musical instruments such as a grand piano and a pipe organ. Thus the freedom of setting of the key depression feeling can be enhanced.

Preferably, the one and the other of the surface of the actuator and the surface of the driven member each have a curvature thereof set such that an amount of movement of a point of contact at which the actuator contacts the driven member is equal to at least a predetermined ratio with respect to a distance between the first fulcrum and the second fulcrum.

According to this arrangement, the moment of rotation generated by the actuator to drive the driven member can be changed to a sufficient extent with pivotal movement of the driven member, to thereby obtain a sufficient range of change of the driving resistance.

Preferably, the other of the surface of the actuator and the surface of the driven member is a flat surface.

According to this arrangement, the characteristic of change of the driving resistance can be linear during the pivotal movement stroke of the driven member. As a result, if the present drive unit structure is applied to a drive unit associated with the key depressing operation and detection of key depression, free setting of the key depression feeling is facilitated.

Also preferably, the drive unit structure according to the fourth aspect includes a key, and a switch board, and the actuator is disposed to pivotally move in response to an operation of depressing the key. The driven member comprises a key switch disposed for contact with the switch board to thereby detect the operation of depressing the key.

According to this arrangement, the characteristic of change of the key depressing resistance can be freely set as desired during the pivotal movement stroke of the driven member, to thereby freely set the key depression feeling. Also in an arrangement that a plurality of key switches are provided to detect key velocity, the accuracy of detection of the key velocity can be enhanced to thereby enhance the key depression feeling.

The above and other objects of the invention will become more apparent from the following detailed description taken in conjunction with the accompanying drawings.

DETAILED DESCRIPTION

The invention will now be described in detail with reference to drawings showing preferred embodiments thereof.

Figure 4:
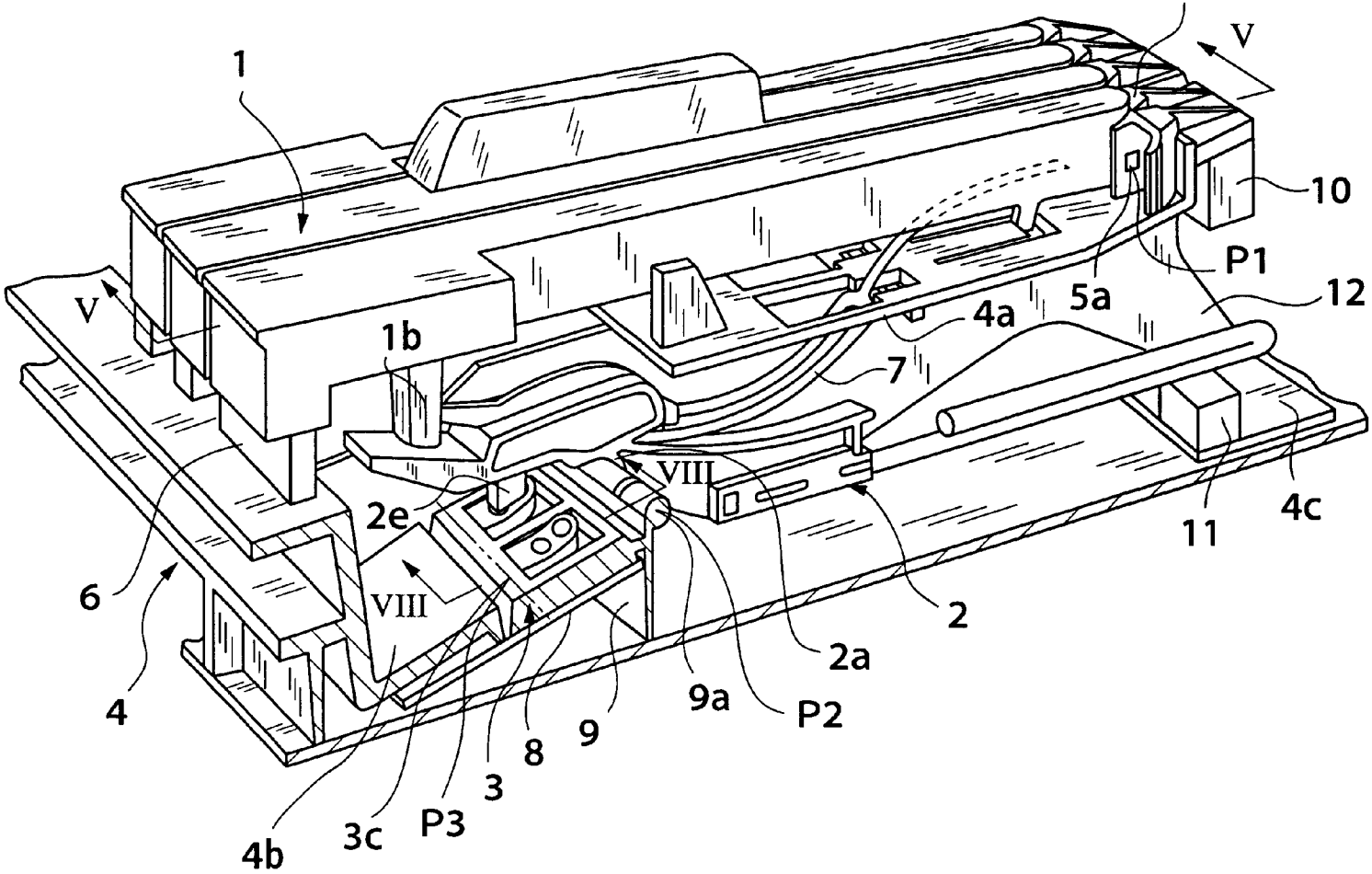
FIG. 4 is a perspective view showing a drive unit structure of a keyboard assembly according to a first embodiment of the invention.

FIG. 4 shows a drive unit structure of a keyboard assembly according to a first embodiment of the invention. The drive unit according to the present embodiment t is mainly comprised of a drive unit including a key (white key) 1, a hammer 2 for imparting a suitable amount of inertia to an operation of depressing the key 1 so as to obtain a key depression feeling such as that of an acoustic piano, a switch 3 for detecting a depression of the key 1, and a support member 9, and a chassis 4 supporting the drive unit. A drive unit associated with a black key is similarly constructed as above and supported by the chassis 4.

Figure 5:
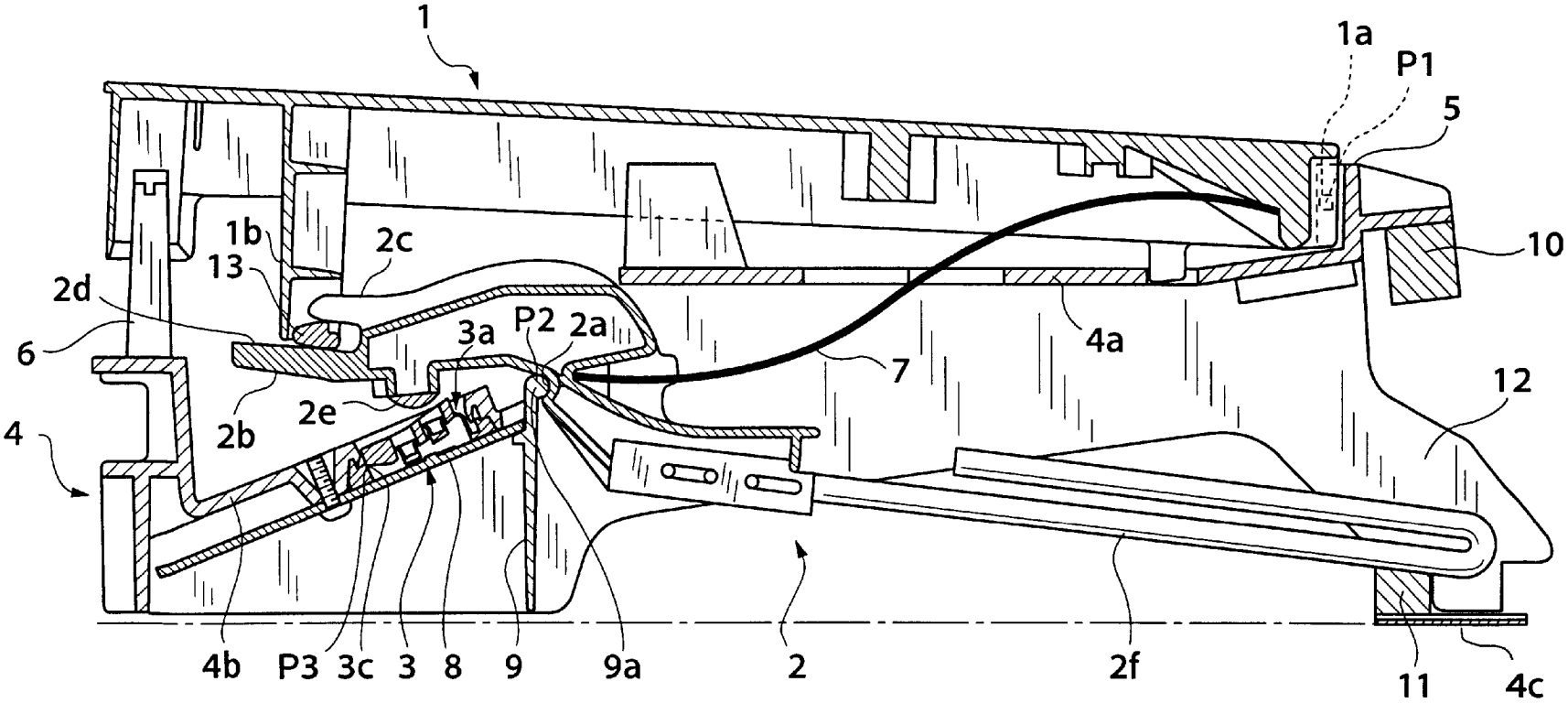
FIG. 5 is a vertical sectional view taken along line V—V in FIG. 4, showing the drive unit structure in a state where a key is not depressed.
Figure 6:
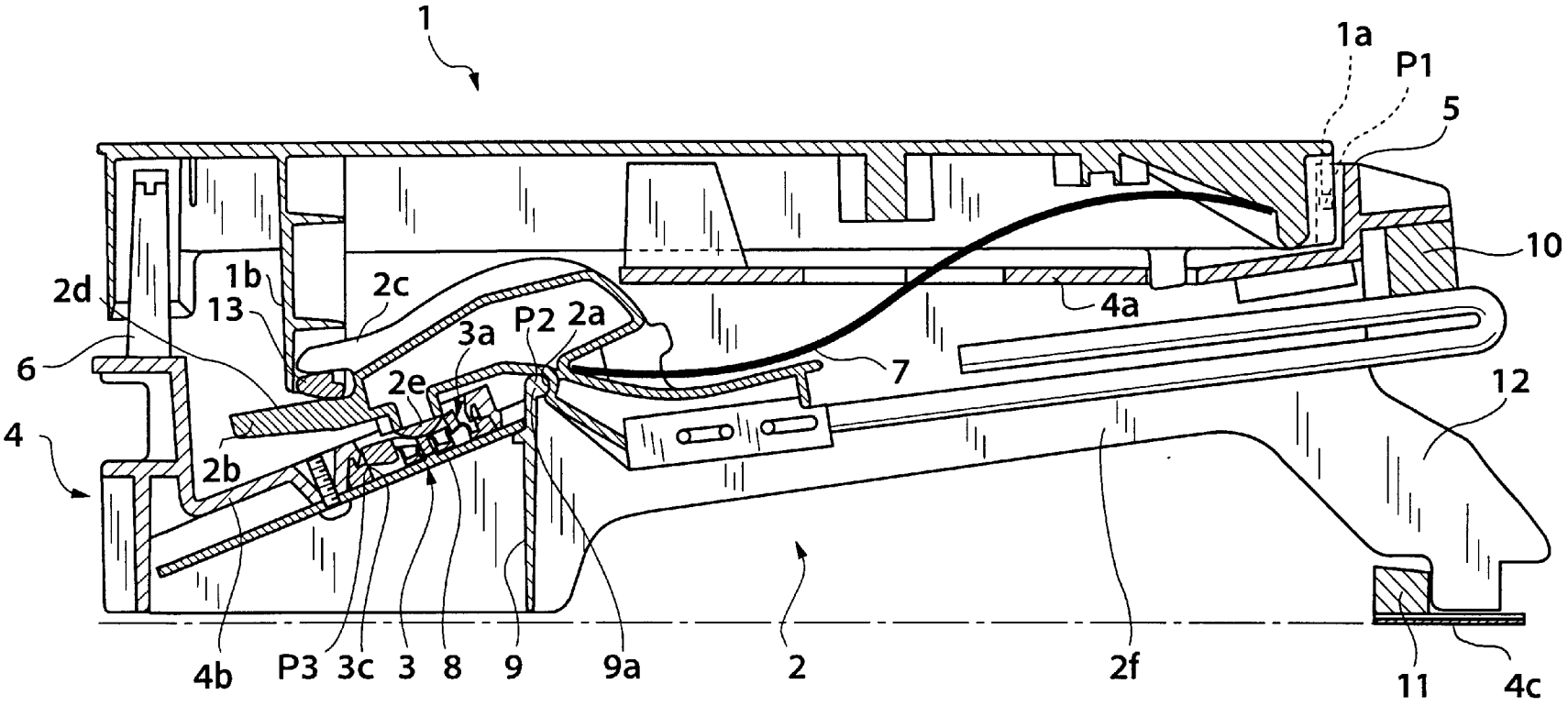
FIG. 6 is a similar view to FIG. 4, showing the drive unit structure in a state where the key is depressed.

FIGS. 5 and 6 are vertical sectional views taken along line V—V in FIG. 4, showing the drive unit structure in a state where the key 1 is not depressed or in an upper limit position and a state where the key 1 is depressed or in a lower limit position, respectively. The key 1, hammer 2 and switch 3 are supported by respective fulcrums P1, P2 and P3 for pivotal movement thereabout in a vertical direction. The key 1 is disposed to drive the hammer 2, and the hammer 2 is disposed to drive the switch 3.

When the key 1 is pivotally moved by a key depressing operation of a player, the hammer 2 and the switch 3 are pivotally moved correspondingly. The key 1 and the hammer 2 are in such a relationship that the former is a driver or actuator and the latter is a driven member, while the hammer 2 and the switch 3 are in such a relationship that the former is a driver or actuator and the latter is a driven member.

The key 1 has a rear end face formed with a key support 1*a* in the form of a projection, while a key support 5 is formed on a rear end of a horizontal portion 4*a* of the chassis 4. The key support 5 has a plurality of concave portions 5*a* at locations facing respective key supports 1*a* of keys 1, as shown in FIG. 4. Each key support 1*a* engages a corresponding concave portion 5*a* such that the key 1 can be vertically pivotally moved about the key support 1*a* (fulcrum P1).

The key 1 has a hammer driving portion 1*b* downwardly pending from a front portion thereof. A damper 13 formed of urethane rubber or a like material is attached to a lower end of the hammer driving portion 1*b*. The damper 13 is interposed between an upper extension 2*c* and a lower extension 2*b* of the hammer 2 to transmit a force produced by depression of the key 1 to the hammer 2 and a force produced by a return motion of the hammer 2 to the key 1. The fulcrum P1 as an axis of rotation of the key 1 and the fulcrum P2 as an axis of rotation of the hammer 2 are not in alignment with each other, and consequently the damper 13 necessarily slides on a sliding surface 2*d* of the hammer 2 as the key 1 is depressed and released. More specifically, when the key 1 is depressed, the damper 13 urgingly slides on the sliding surface 2*d* of the hammer 2 to cause the hammer 2 to downwardly move or rotate, while when the key 1 is released, the damper 13 slides back on the sliding surface 2*d* to allow the key 1 to be returned into a non-depressed position. During both key depression stroke and key release stroke, the damper 13 has its upper side always kept in contact with the upper extension 2*c* of the hammer 2 to secure stable transmission of forces of key depression and key release.

The chassis 4 has a front portion 4*b* coupled to the horizontal portion 4*a* and reinforced by a rib 12. A plurality of key guides 6 are provided for respective keys 1 and secured to and upwardly extends from the front portion 4*b* of the chassis, for limiting lateral movement of the respective keys 1. A chassis retainer 4*c* is provided at a rear and lower portion of the chassis 4, and retains the chassis 4 in place as well as prevents the hammer 2 from falling out of its proper place after mounting of the hammer 2 into the chassis 4.

The hammer 2, which is provided for each key 1, is supported at a fulcrum 2*a* thereof by the support member 9 for vertical pivotal movement about an upper edge or fulcrum 9*a* (fulcrum P2) of the support member 9. A fork-shaped spring 7 is bridged between a portion of the hammer 2 near its fulcrum 2*a* and a rear end portion of the key 1, in a manner urging the key 1 against the key support 5 and the hammer 2 against the fulcrum 9*a* of the support member 9 so as to prevent the key 1 and the hammer 2 from falling out of the chassis 4.

The hammer 2 has a mass member 2*f* extending rearward such that the lower extension 2*b* of the hammer 2 permanently upwardly urges the key 1 due to the weight of the mass member 2*f*. Thus, the key 1 is given a force for returning the same into its non-depressed position by the hammer 2 rather than the spring 7.

Figure 7:
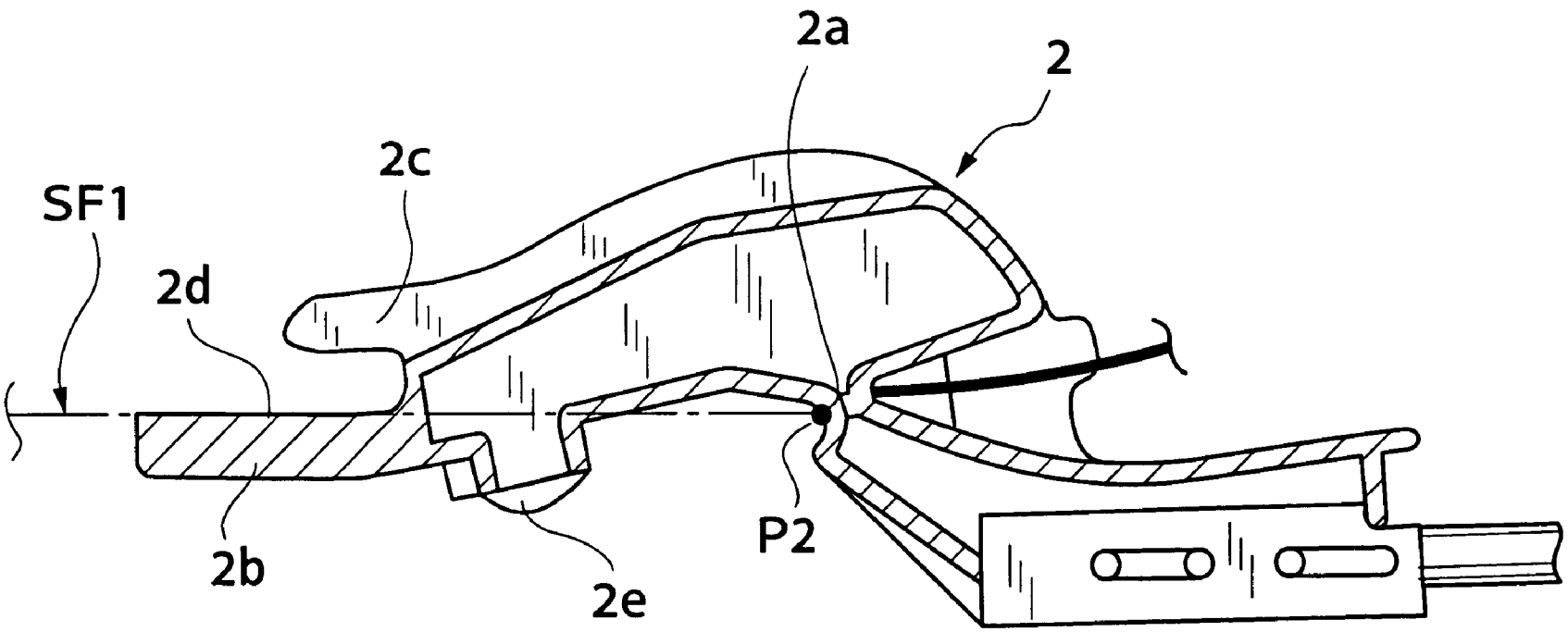
FIG. 7 is a side view, partly in section, showing a hammer appearing in FIG. 4.

FIG. 7 shows on an enlarged scale details of the hammer 2. The sliding surface 2*d* of the hammer 2 is a flat surface, and the fulcrum P2 is located in a plane SF1 including the sliding surface 2*d*. By this setting, the minimum distance from the fulcrum P2 of the hammer 2 to the plane SF1 is zero. As a result, it can be avoided that a frictional force generated between the damper 13 provided on the key 1 and the sliding surface 2*d* of the hammer 2 during key depression theoretically acts upon the hammer 2 as a driven member as the moment of rotation.

The hammer 2 has a switch driving portion 2*e* for driving the switch 3. The switch driving portion 2*e* has a a generally convex end acting as an actuator for pushing down the switch 3 as the key is depressed.

Referring back to FIGS. 5 and 6, upper and lower stoppers 10 and 11 formed of felt or a like material are provided on a rear end of the horizontal portion 4*a* and the chassis retainer 4*c*. The upper stopper 10 urgingly contacts the mass member 2*f* of the hammer 2 when the key is depressed, to thereby stop the key 1 in its lowermost position, and the lower stopper 11 urgingly contacts the mass member 2*f* when the key 1 is released, to thereby hold the key 1 in its uppermost position.

A switch board 8 is mounted on the front portion 4*b* of the chassis 4, on which the switch 3 is provided. The switch 3 is provided for each hammer 2 and disposed in opposed relation to the switch driving portion 2*e* of the hammer 2.

Figure 8:
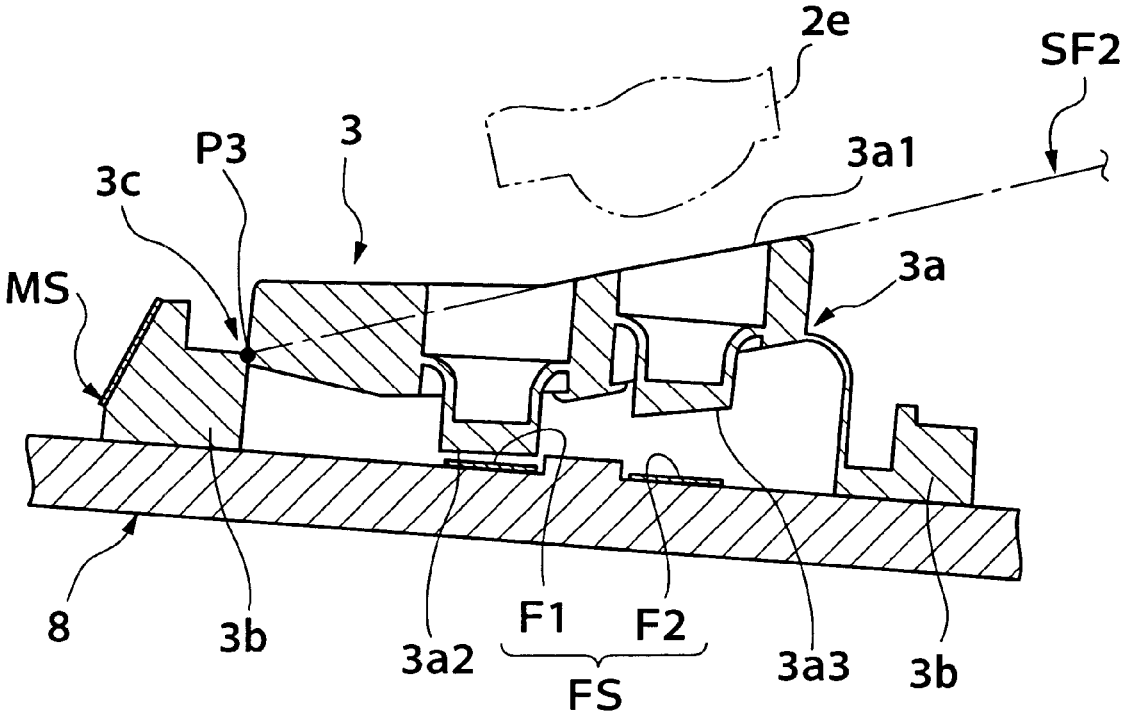
FIG. 8 is a vertical sectional view taken along line VIII—VIII in FIG. 4, showing in detail the hammer and a switch appearing in FIG. 4.

FIG. 8 is a vertical sectional view taken along line VIII—VIII in FIG. 4, showing in detail the switch 3. The switch 3 is a two-make touch response switch of a contact time difference type which has a fixed section FS and a movable section MS. The fixed section FS is formed of fixed contacts F1 and F2 formed by comb-like patterns applied on an upper surface of the switch board 8. The movable section MS is formed of an elastic swelled portion 3*a*, a base 3*b*, and a hinge 3*c*. The swelled portion 3*a* has first and second make movable contacts 3*a*2 and 3*a*3 disposed in opposed relation to the fixed contacts F1, F2, respectively.

The swelled portion 3*a* is vertically pivotable about the hinge 3*c* (fulcrum P3) due to its own elasticity. The fulcrum P2 of the hammer 2 and the fulcrum P3 of the switch 3 do not coincide in position with each other. Accordingly, similarly to the aforementioned case where the damper 13 provided on the key 1 urgingly slides on the hammer 2, as the hammer 2 rotates in response to depression of the key 1, the switch driving portion 2*e* of the hammer 2 urgingly slides on a sliding surface 3*a*1 of the switch 3 to cause pivotal movement of the swelled portion 3*a*. Thus, the switch driving portion 2*e* necessarily slides on the sliding surface 3*a*1 when the former contacts the latter. As the swelled portion 3*a* moves downward, first the movable contact 3*a*2 urgingly contacts the fixed contact F1, and then the movable contact 3*a*3 urgingly contacts the fixed contact F2, to thereby detect key depression, key depression velocity, etc. The keyboard assembly according to the present invention has a function of electrically reproducing and generating musical tones of musical instruments such as grand piano in response to signals indicative of the key depression, key depression velocity, etc.

The sliding surface 3*a*1 of the swelled portion 3*a* is formed as a flat surface, and the hinge 3*c* is present in a plane SF2 including the sliding surface 3*a*1. By this setting, the minimum distance from the fulcrum P3 of the switch 3 to the plane SF2 is zero. As a result, it can be avoided that a frictional force generated between the switch driving portion 2*e* of the hammer 2 and the sliding surface 3*a*1 of the switch 3 during key depression theoretically acts upon the switch 3 as a driven member as the moment of rotation.

Figure 9:
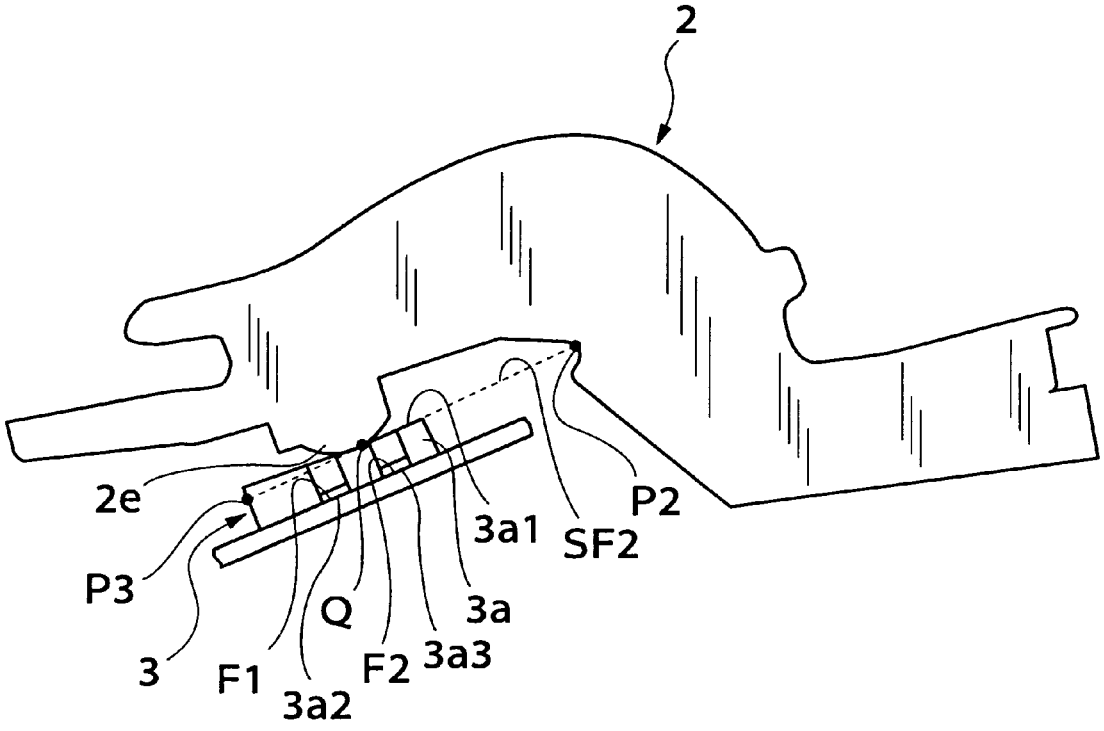
FIG. 9 is a view showing the hammer and the switch in a state where the switch is closed.

FIG. 9 schematically shows the hammer 2 and the switch 3 in a state where the movable contacts 3*a*2 and 3*a*3 contact the fixed contacts F1 and F2.

As the switch 3 is pushed down by the switch driving portion 2*e* of the hammer 2, the swelled portion 3*a* is collapsed so that the movable contacts 3*a*2, 3*a*3 urgingly contact the fixed contacts F1, F2, as shown in FIG. 9. In this closed position of the switch 3, the position of the sliding surface 3*a*1 is different from that when the key 1 is not depressed. That is, in the present embodiment, it is so set that during the stroke of pivotal movement of the hammer 2 the plane SF2 including the sliding surface 3*a*1 of the switch 3 passes the fulcrum P2 of the hammer 2 and when the switch 3 is closed with the movable contacts 3*a*2, 3*a*3 in contact with the fixed contacts F1, F2, the hammer fulcrum P2 is present in the plane SF2.

As stated above, a frictional force is generated between the switch driving portion 2*e* of the hammer 2 and the sliding surface 3*a*1 of the switch 3 which are in sliding contact with each other (at point of contact Q), which acts upon the hammer 2 as well. By setting the relative position between the sliding surface 3*a*1 and the hammer fulcrum P2 as mentioned above, however, the moment of rotation acting upon the hammer 2 as the driving member due to the frictional force is the minimum when the switch 3 is closed with the movable contacts 3*a*2, 3*a*3 in contact with the fixed contacts F1, F2.

Figure 10:
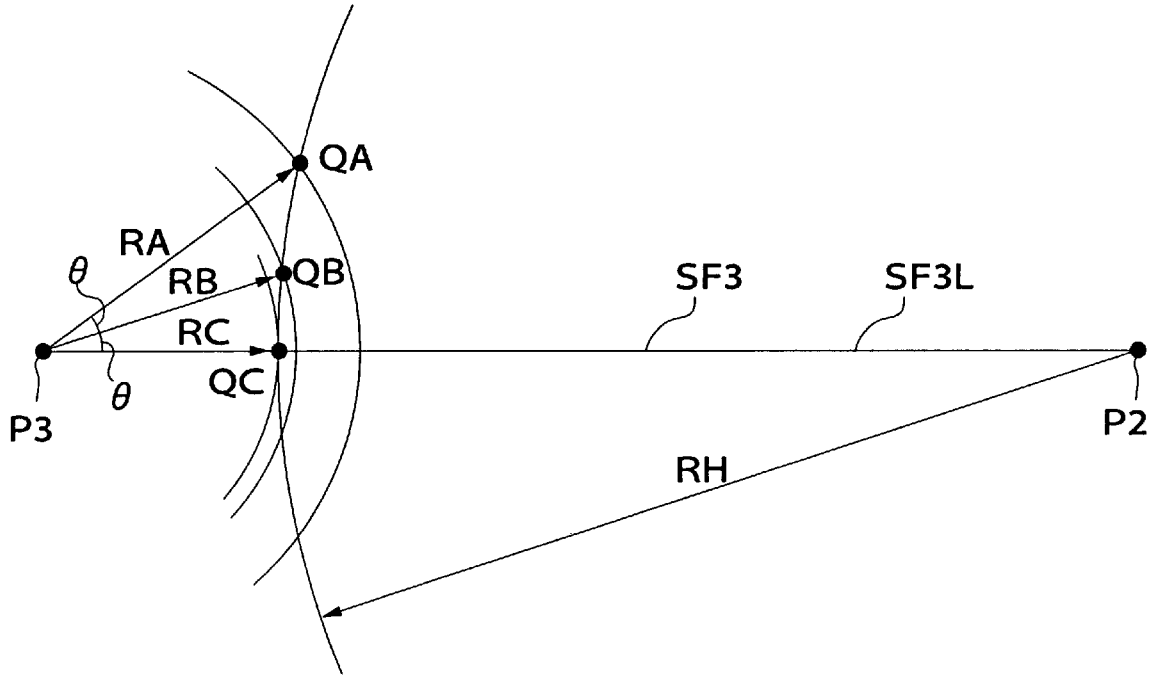
FIG. 10 is a diagram showing a locus depicted by a point of contact between the hammer and the switch during a key depression stroke.

FIG. 10 diagrammatically shows a locus depicted by the point of contact Q between the hammer 2 and the switch 3 during the pivotal movement stroke of the hammer 2. The present drive unit structure is set such that during the pivotal movement stroke of the hammer 2, the point of contact Q traverses a plane SF3 including the hammer fulcrum P2 and the switch fulcrum P3 (i.e. the locus of the point of contact Q intersects a segment SF3L extending between the hammer fulcrum P2 and the switch fulcrum P3), and particularly when the movable contacts 3*a*2, 3*a*3 contact the fixed contacts F1, F2 during the key depression stroke, the point of contact Q lies in the plane SF3.

The point of contact Q depicts an arcuate locus having a radius RH about the hammer fulcrum P3. On the other hand, the point of contact Q on the sliding surface 3*a*1 of the switch 3 gradually moves as the switch driving portion 2*e* of the hammer 2 slides on the sliding surface 3*a*1, and accordingly the distance between the switch fulcrum P3 and the point of contact Q gradually changes. That is, from a time point when the hammer 2 starts sliding to a time point when the movable contacts 3*a*2, 3*a*3 contact the fixed contacts F1, F2 through an intermediate position, the point of contact Q moves through points QA, QB,, and QC in the order mentioned, as shown in FIG. 10. Accordingly, the distance between the switch fulcrum P3 and the point of contact Q (radius) changes from RA to RC through RB (RA>RB>RC). Therefore, the moving distance of the point of contact Q on the sliding surface 3*a*1, i.e. the relative sliding distance D between the switch driving portion 2*e* and the sliding surface 3*a*1 is expressed by the following formulas (1) and (2):

$$D1=RA-RB \quad (1)$$

$$D2=RB-RC \quad (2)$$

where D1 represents the sliding distance after the switch driving portion 2*e* starts sliding and before it reaches the intermediate position, and D2 represents the sliding distance after it leaves the intermediate position and before the movable contacts contact the fixed contacts.

As is clear from FIG. 10, the sliding distance D2 is smaller than the sliding distance D1. That is, during the key depression stroke, the sliding distance D is smaller as the point of contact Q is closer to the plane SF3. The present drive unit structure is constructed such that the point of contact Q lies on the plane SF3 when the movable contacts are in contact with the fixed contacts, as mentioned above. As a result, the frictional force generated between the hammer 2 and the switch 3 can be reduced to the minimum when the movable contacts are in contact with the fixed contacts.

The present drive unit structure is further set such that the point of contact Q remains located between the hammer fulcrum P2 and the switch fulcrum P3 all the time during the key depression stroke, in other words, the locus depicted by the point of contact Q lies between the hammer fulcrum P2 and the switch fulcrum P3.

Figure 11A:
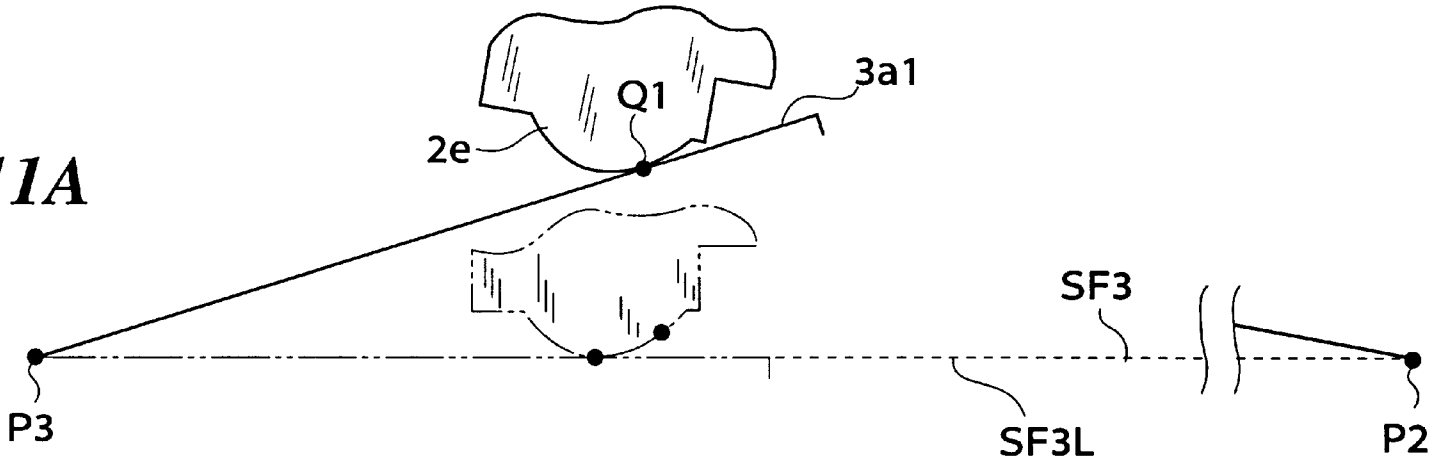
FIGS. 11A and 11B are diagram schematically showing how a switch driving portion of the hammer slidingly moves on a sliding surface of the switch, according to the first embodiment.
Figure 11B:
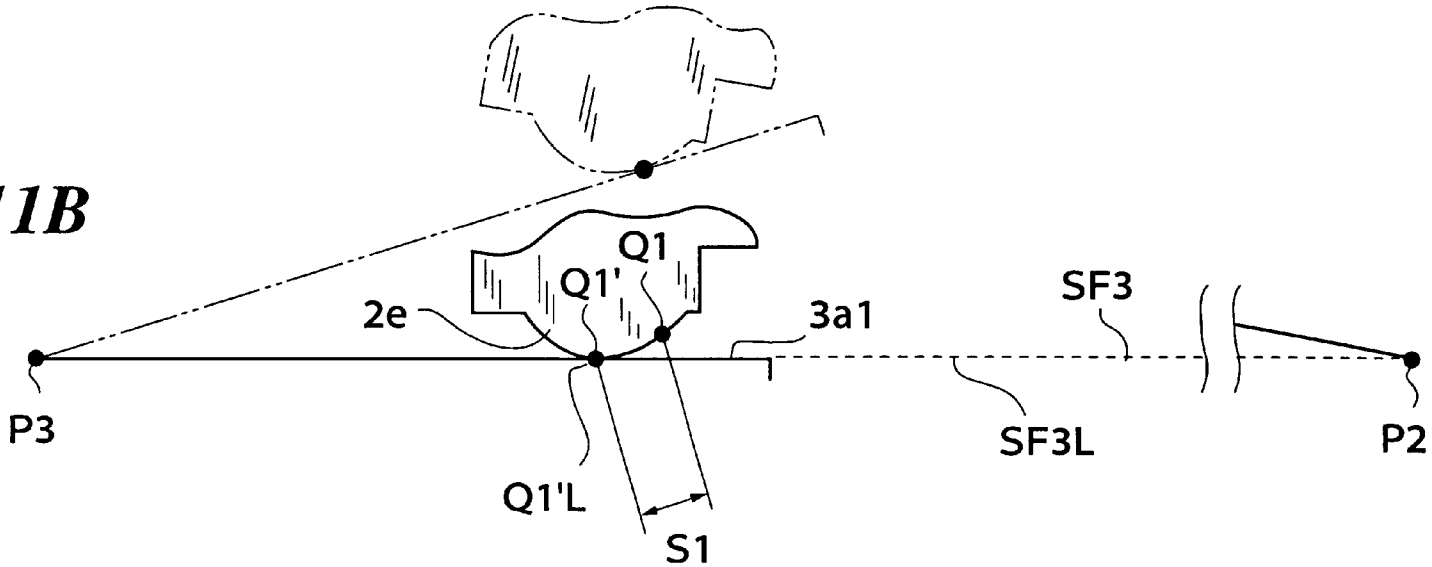
Figure 12A:
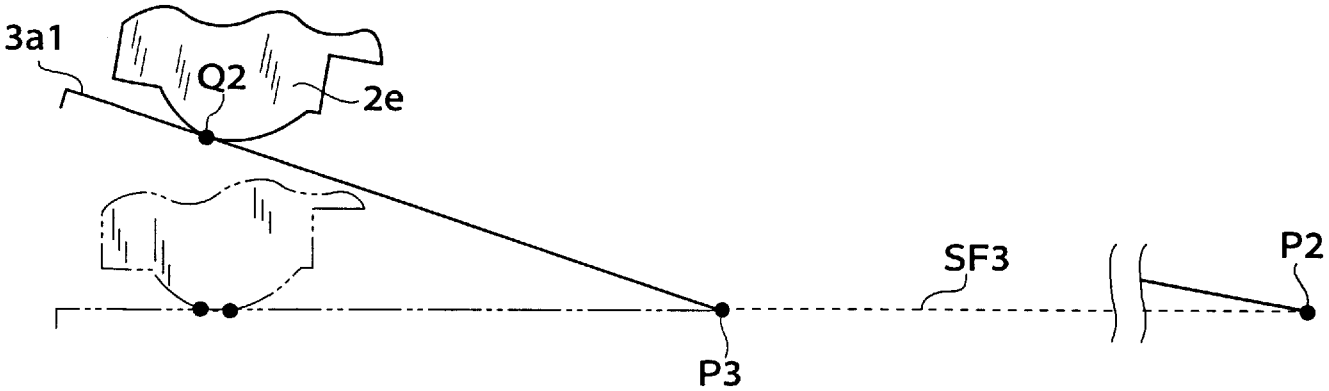
FIGS. 12A and 12B are similar in view to FIG. 11, according to a second embodiment of the invention.
Figure 12B:
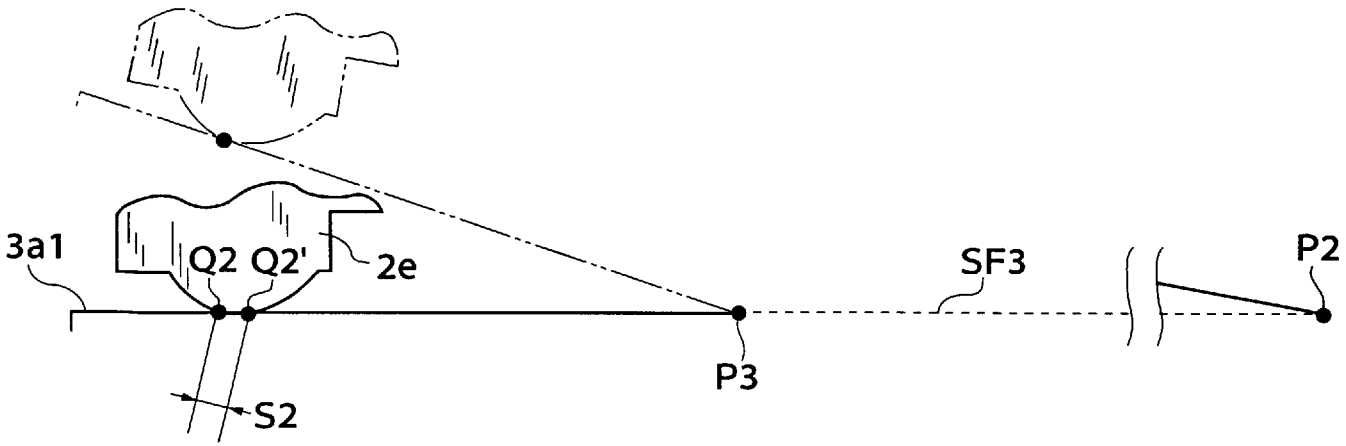

FIGS. 11 and 12 schematically show how the switch driving portion 2*e* of the hammer 2 slidingly moves on the sliding surface 3*a*1 of the switch 3. FIG. 11 shows a case where the point of contact Q is located between the hammer fulcrum P2 and the switch fulcrum P3, and FIG. 12 shows a case where the point of contact Q does not lie between the hammer fulcrum P2 and the switch fulcrum P3, but lies on a side of the switch fulcrum P3 remote from the hammer fulcrum P2. In these figures, symbol (A) represents a state at the start of sliding, and (B) a state during contacting of the movable contacts with the fixed contacts.

The switch driving portion 2*e* of the hammer 2 strictly does not always contact the sliding surface 3*a*1 at the same point during the key depression stroke. This is because the hammer 2 and the switch 3 rotate about respective different fulcrums.

More specifically, as shown in FIG. 11, as the hammer 2 is pivotally moved downward, the switch driving portion 2*e* rotates counterclockwise and rolls on the sliding surface 3*a*1 leftward as viewed in the figure. The switch driving portion 2*e* contacts the sliding surface 3*a*1 at a point Q1 at the start of sliding, and at a point Q1' when the movable contacts contact the fixed contacts. The direction in which the switch driving portion 2*e* slides on the sliding surface 3*a*1 is identical with the direction in which the switch driving portion 2*e* rolls (leftward as viewed in the figure), and accordingly the actual sliding distance of the switch driving portion 2*e* on the sliding surface 3*a*1 is shorter than the apparent sliding distance by a distance S1 of the arcuate portion between the points Q1 and Q1'. Thus, the sliding distance can be reduced.

On the other hand, in a second embodiment of the invention shown in FIG. 12, as the hammer 2 is pivotally moved downward, the switch driving portion 2*e* rotates counterclockwise. However, the hammer fulcrum P2 and the switch fulcrum P3 both lie on the right side of the point of contact Q with the switch fulcrum P3 being closer to the point Q, and consequently the switch driving portion 2*e* slightly rolls on the sliding surface 3*a*1 rightward. The switch driving portion 2*e* contacts the sliding surface 3*a*1 at a point Q2 at the start of sliding, and at a point Q2' when the movable contacts contact the fixed contacts. The amount of rolling of the switch driving portion 2*e* on the sliding surface 3*a*1 in the rightward direction as viewed in FIG. 12 is so small that the actual sliding distance of the switch driving portion 2*e* on the sliding surface 3*a*1 is smaller than the apparent sliding distance only by a distance S2 of the arcuate portion between the points Q2 and Q2' which is shorter than the distance S1.

In this manner, by virtue of the position setting as shown in FIG. 11, the sliding distance between the hammer 2 and the switch 3 taken when the point of contact Q approaches the plane SF3 including the fulcrums P2, P3 of the hammer 2 and the switch 3 during the key depression stroke can be shortened. Further, since in the present embodiment it is so set that the point of contact Q can traverse the plane SF3, the point of contact Q similarly approaches the plane SF3 also at an initial stage of return from the lower limit position at the end of key depression. As a result, the sliding amount and the sliding resistance can be reduced at the initial stage of key depression which is an important depression timing at which the key is accelerated.

The point of contact Q may not necessarily completely traverse the plane SF3 to obtain the above-mentioned results. That is, it suffices that the segment SF3L connecting between the hammer fulcrum P2 and the switch fulcrum P3 (identical with the plane SF3 as viewed in FIG. 11) is interior-divided by a point Q1'L (identical with the point Q1' in the example illustrated in FIG. 11) on the segment SF3L, which is closest to the locus of the point of contact Q.

According to the present embodiment, it is so set that the hammer fulcrum P2 lies in the plane SF1 including the sliding surface 2*d* of the hammer 2 (FIG. 7). Consequently, the frictional force generated by sliding of the damper 13 on the sliding surface 2*d* does not act upon the hammer 2 as the moment of rotation. Further, it is so set that the hinge 3*c* of the switch 3 lies in the plane SF2 including the sliding surface 3*a*1 of the swelled portion 3*a* of the switch 3 (FIG. 8). Consequently, the frictional force generated by sliding of the switch driving portion 2*e* of the hammer on the sliding surface does not act upon the switch as the moment of rotation. Thus, no resisting force due to the moment of rotation does not act upon the elements as the driven members. As a result, the operations of the actuator and driven member can be stable, to thereby enhance the accuracy of transmission of the operation of the actuator to the driven member. More specifically, in the case where the hammer 2 acts as the driven member, the feeling of touch can be improved, and in the case where the switch 3 acts as the driven member, the feeling of touch and accuracy of detection of key depression can be improved.

Further, according to the present embodiment, the plane including the sliding surface 3*a*1 of the switch 3 can pass through the hammer fulcrum P2 during pivotal movement stroke of the hammer 2 (FIG. 9), the frictional force generated by sliding of the switch driving portion 2*e* on the sliding surface 3*a*1 cannot act upon the hammer 2 as the moment of rotation about the hammer fulcrum P2 when the plane passes the hammer fulcrum P2, so that the resisting force against the driving operation becomes the minimum. As a result, the operations of the actuator and driven member can be stable, to thereby enhance the accuracy of transmission of the operation of the actuator to the driven member, but also the feeling of touch can be improved due to the reduced key depressing resistance.

Particularly, the hammer fulcrum P2 lies in the plane including the sliding surface 3*a*1 of the switch 3 when the movable contacts contact the fixed contacts (FIG. 9). As a result, the operations of the actuator and driven member can be stable at the time of contacting of the movable contacts with the fixed contacts, which is the most important timing for detecting the key depressing operation, to thereby enhance the accuracy of detection of the key depressing operation.

According to the present embodiment, the point of contact Q can traverse the plane SF3 including the hammer fulcrum P2 and the switch fulcrum P3 during pivotal movement stroke of the hammer 2 (FIG. 11). Consequently, the amount of relative sliding of the hammer 2 and the switch 3 can be reduced to the minimum and hence the frictional force is reduced to thereby reduce the resistance to the operations of the actuator and driven member. As a result, the operations of the actuator and driven member can be stable, to thereby enhance the accuracy of transmission of the operation of the actuator to the driven member, but also the feeling of touch can be improved due to the reduced key depressing resistance. Further, the effective life of the drive unit can be prolonged.

Particularly, the point of contact Q lies on the plane SF3 at the time of contacting of the movable contacts with the fixed contacts during the key depression stroke (FIG. 11). As a result, the operations of the actuator and driven member can be stable at the time of contacting of the movable contacts with the fixed contacts, which is the most important timing for detecting the key depressing operation, to thereby enhance the accuracy of detection of the key depressing operation.

Moreover, according to the present embodiment, the locus depicted by the point of contact Q lies between the hammer fulcrum P2 and the switch fulcrum P3 (not on a side of either one of these fulcrums remote from the other) (FIG. 11).

Consequently, the sliding distance can be shortened, and hence the sliding amount can be reduced at an initial stage of the forward operations of the actuators and driven members, to a smaller distance than at a terminating stage thereof. As a result, the key depressing resistance can be reduced at the initial stage of key depressing operation which is an important depression timing when the key is accelerated, whereby the operations of the actuator and driven member can be stable to improve the feeling of touch.

Although in the present embodiment it is so set that the plane including the sliding surface 3*a*1 of the switch 3 passes the hammer fulcrum P2 during the pivotal movement stroke of the hammer 2 (FIG. 9), this relationship may be also applied to the pair of the key as the actuator and the hammer 2 as the driven member, providing substantially the same results.

Further, although in the present embodiment the time point at which the hammer fulcrum P2 becomes located in the plane including the sliding surface 3*a*1 of the switch 3 is set to the time point of contacting of the movable contacts with the fixed contacts, alternatively it may be set to time point at which the key 1 is in the lower limit position at the end of key depression (so-called key flapping position at the end of key depression stroke). This can stabilize the operations of the actuator and driven member at the time point which most influences the feeling of after touch, to thereby further improve the feeling of touch.

Although in the present embodiment it is so set that the point of contact Q passes the plane SF3 including the hammer fulcrum P2 and the switch fulcrum P3 during pivotal movement stroke of the hammer 2, and then the point of contact Q depicts a locus at a location between the hammer fulcrum P2 and the switch fulcrum P3 (not on a side of either one of these fulcrums remote from the other) (FIG. 11), this relationship may be also applied to the pair of the key as the actuator and the hammer 2 as the driven member, providing substantially the same results.

Further, although in the present embodiment the time point at which the point of contact Q becomes located on the plane SF3 is set to the time point of contacting of the movable contacts with the fixed contacts during the key depression stroke (FIG. 11), alternatively it may be set to time time point at which the key 1 is in the lower limit position at the end of key depression (so-called key flapping position at the end of key depression stroke). This can further improve the feeling of touch.

Moreover, although in the present embodiment the switch driving portion 2*e* of the hammer 2 as the actuator is shaped in the form of a convex, and the sliding surface 3*a*1 of the switch 3 as the driven member in sliding contact with the former is shaped in the form of a flat surface, their shapes may be replaced with each other into a reverse sliding relationship. Besides, the flat surface need not be strictly flat but may be slightly gently curved with a small curvature. This may also apply to the pair of the key as the actuator and the hammer 2 as the driven member.

Figure 13:
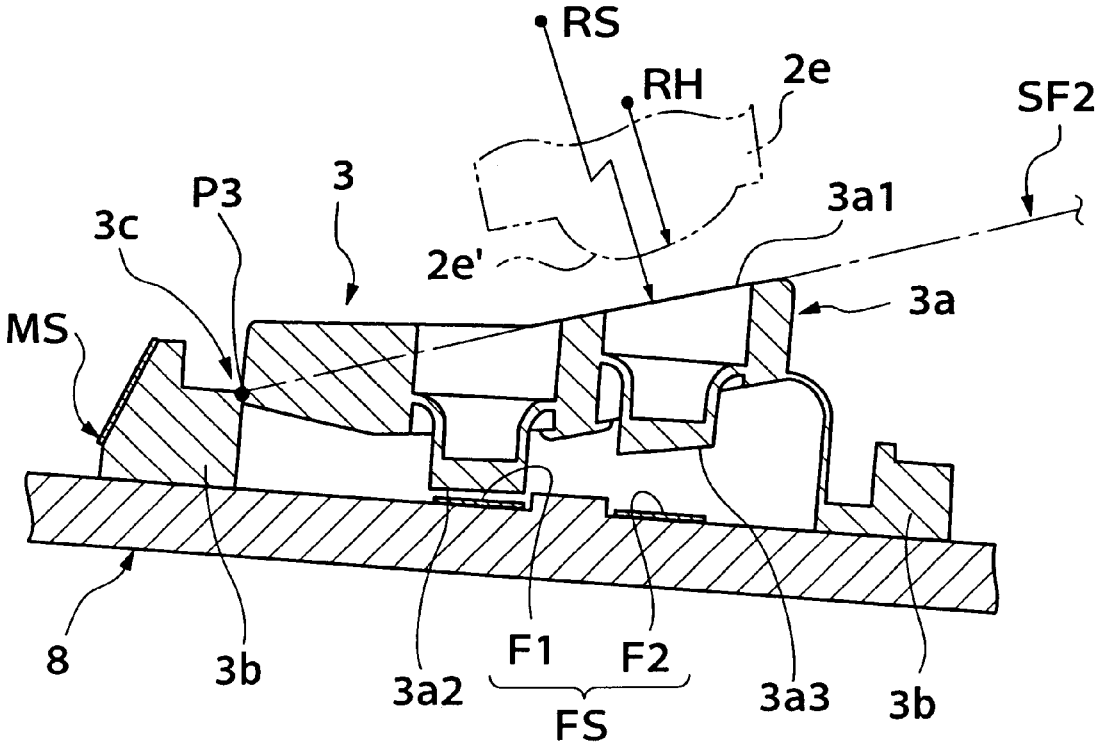
FIG. 13 is a view similar to FIG. 8 showing a hammer and a switch according to a third embodiment of the invention.

FIG. 13 shows the hammer 2 and the switch 3 according to a third embodiment of the invention.

The third embodiment is distinguished from the above described first embodiment in that the curvatures of the switch driving portion 2*e* of the hammer 2 and the sliding surface 3*a*1 of the switch 3 are specified in predetermined relation to each other.

The switch driving portion 2*e* of the hammer 2 has a tip surface 2*e*' having a semi-cylindrical shape of a convex section. More specifically, in the present embodiment, if the radii of curvature of the tip surface 2*e*' and the sliding surface 3*a*1 are represented by RH and RS, respectively, the curvature 1/RS of the sliding surface 3*a*1 is set to a smaller value than the minimum curvature 1/RH of the tip surface 2*e*'. In the illustrated embodiment, the sliding surface 3*a*1 is a flat surface with its radius of curvature RS being infinite, and therefore the curvature is zero. The present invention is not limited to this setting, but one of the tip surface 2*e*' of the switch driving portion 2*e* and the sliding surface 3*a*1 of the switch 3 may have a convex section and the other has a curvature smaller than the minimum curvature of the one.

Figure 14A:
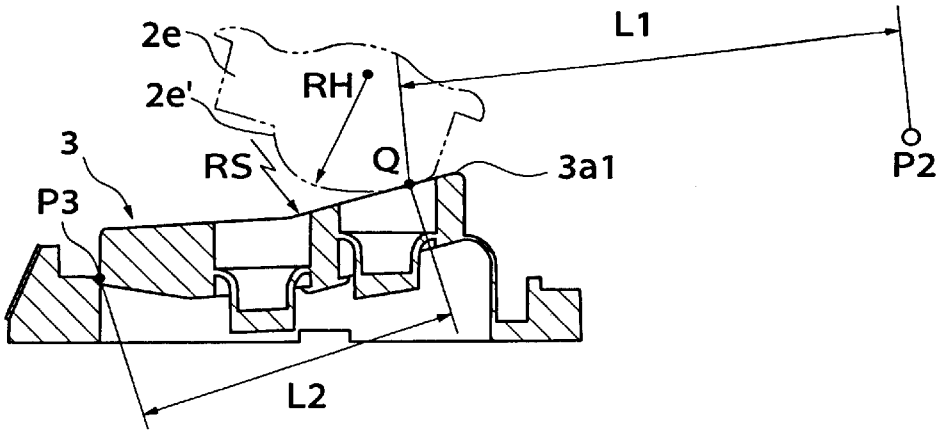
FIG. 14A is a fragmentary sectional views showing the hammer and the switch according to the third embodiment and useful in explaining how the hammer drives the switch, with the drive unit structure at an initial stage of key depression stroke.
Figure 14B:
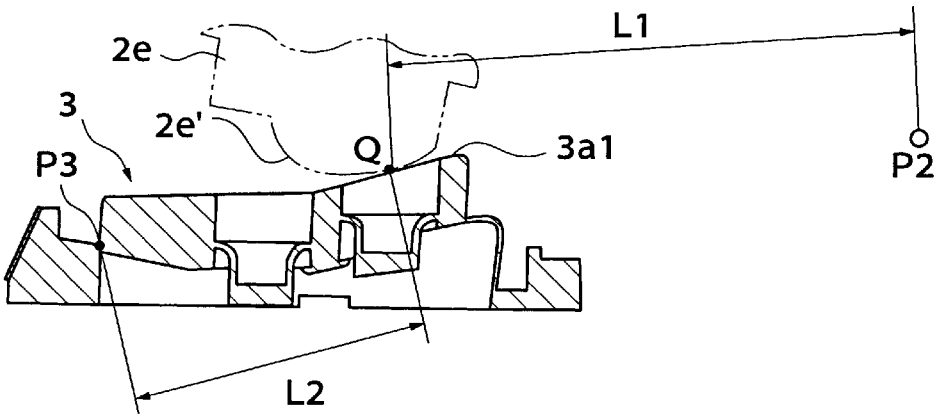
FIG. 14B shows the same at an intermediate stage of the key depression stroke.
Figure 14C:
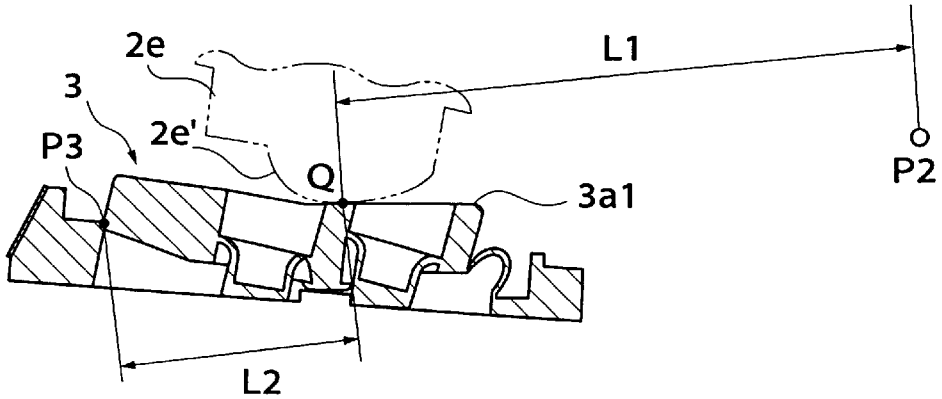
FIG. 14C shows the same at termination of the key depression stroke.

FIGS. 14A to 14C show a drive unit structure according to the third embodiment of the invention and useful in explaining how the hammer 2 drives the switch 3. FIG. 14A shows the drive unit structure at an initial stage of key depression stroke in which the switch driving portion 2*e* of the hammer 2 contacts the sliding surface 3*a*1 of the switch 3, FIG. 14B shows the same at an intermediate stage of the key depression stroke in which the movable contact 3*a*2 contacts the fixed contact F1, and FIG. 14C shows the same at a termination stage of the key depression stroke in which the key 1 has been depressed through the full stroke into its lower limit position with the movable contact 3*a*3 in contact with the fixed contact F2.

Assuming that the distance between the point of contact Q at which the switch driving portion 2*e* of the hammer 2 contacts the sliding surface 3*a*1 of the switch 3 is represented by symbol L1, and the distance between the point of contact Q and the switch fulcrum P3 by symbol L2, the position of the point of contact Q progressively changes due to the above described setting, so that a ratio L2/L1 of the distance L2 to the distance L1 (hereinafter referred to as the expansion ratio EXP) changes accordingly.

Figure 15:
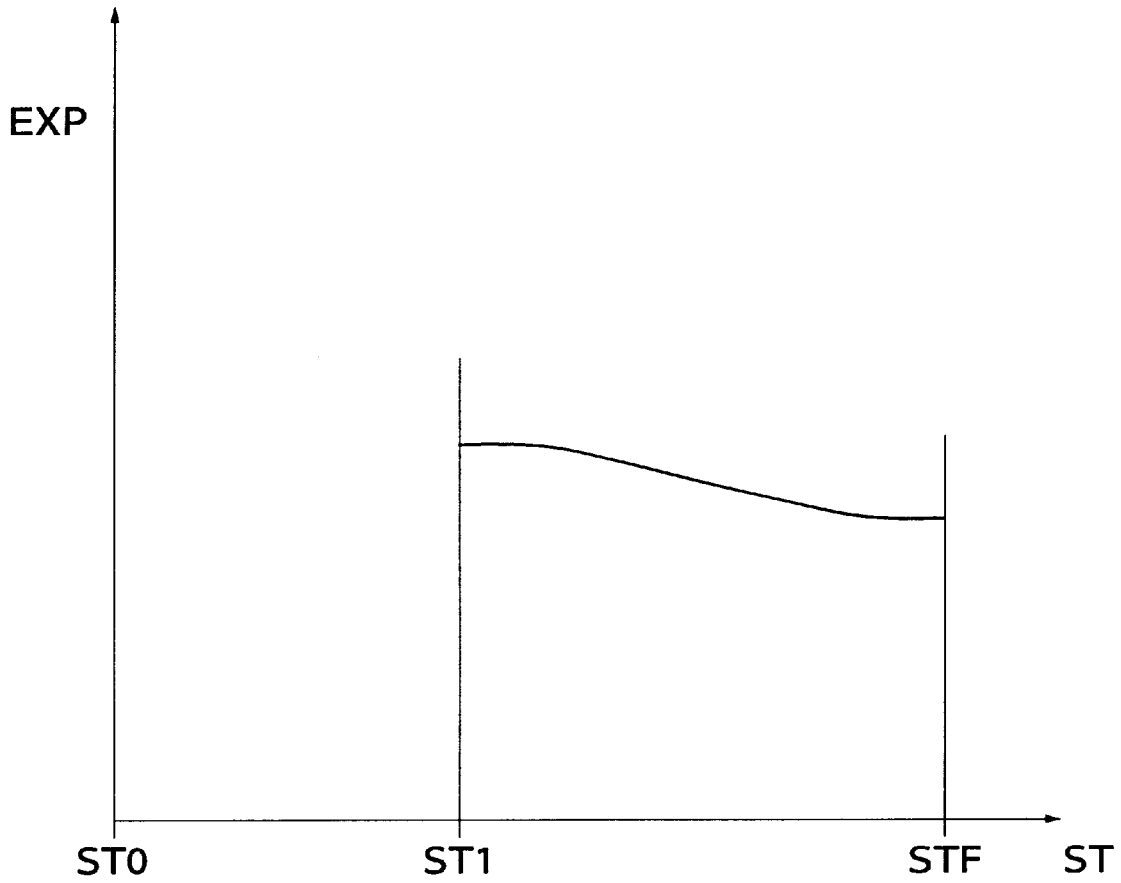
FIG. 15 is a graph showing a change in an expansion ratio EXP of the drive unit structure according to the third embodiment.

FIG. 15 shows a change in the expansion ratio EXP. In the figure, the abscissa indicates the position ST of the key 1 during the key depression stroke, and the ordinate indicates the expansion ratio EXP. Symbol STO on the abscissa indicates the starting position of key depression (the position in which the key 1 is not depressed), symbol ST1 a position of the key 1 at which the hammer 2 contacts the switch 3 (corresponding to FIG. 14A), and symbol STF a position in which the key 1 has been fully depressed, or the lower limit position at the end of key depression (corresponding to FIG. 14C).

The position of the point of contact Q changes in response to the relationship between the hammer fulcrum P2 and the switch fulcrum P3 and the relationship between the curvature 1/RH of the switch driving portion 2*e* and the curvature 1/RS of the sliding surface 3*a*1, and moves leftward as viewed in FIGS. 14A to 14C as the key 1 is depressed. With the movement of the point of contact Q, the distance L1 progressively increases, while the distance L2 progressively decreases, so that the expansion ratio EXP decreases almost linearly over the key positions ST1 to STF, as shown in FIG. 15. Accordingly, the moment of rotation generated by the hammer 2 to drive the switch 3, i.e. the driving resistance progressively increases.

Figure 16:
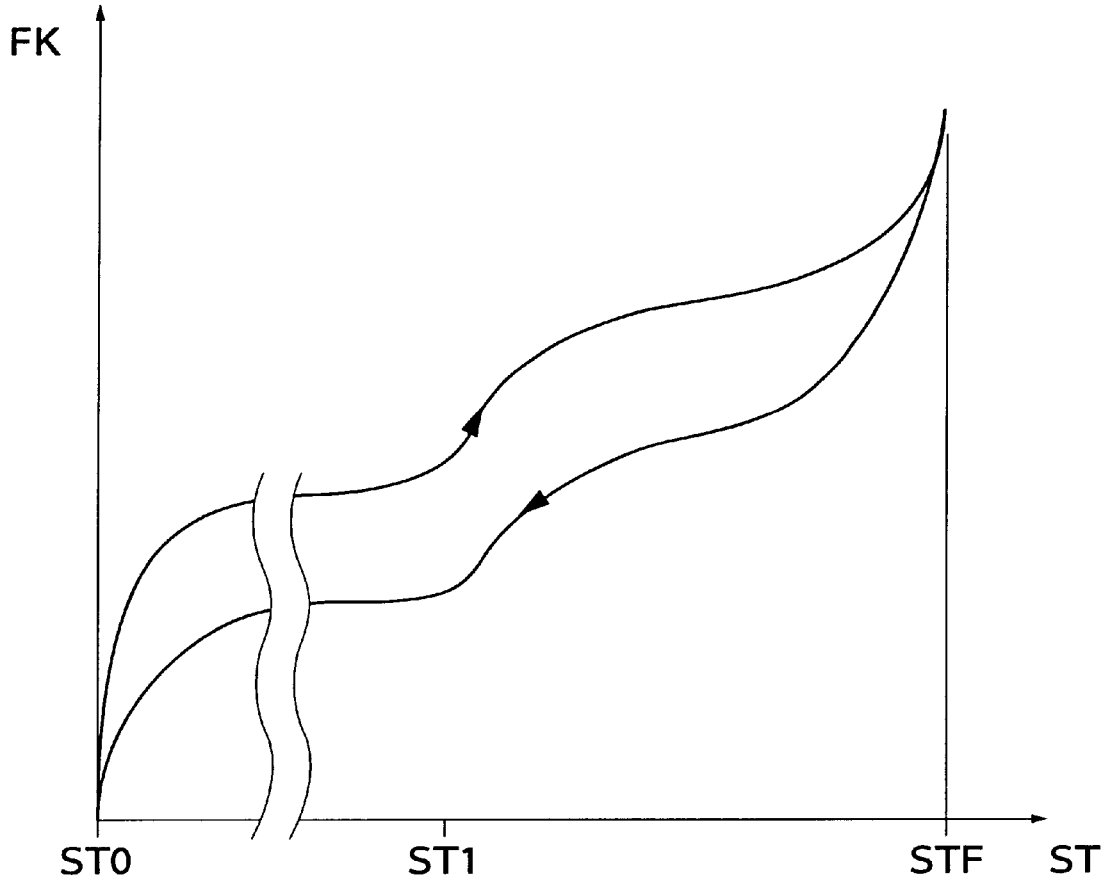
FIG. 16 is a graph showing a change in the key depression resistance FK of the drive unit structure according to the third embodiment.

FIG. 16 is a graph showing a change in the key depression resistance FK of the drive unit structure according to the present embodiment. In the figure, the abscissa indicates the position ST of the key 1 during the key depression stroke, and the ordinate indicates the depression resistance FK, i.e. the load transmitted to the figure through the key 1.

Figure 1:
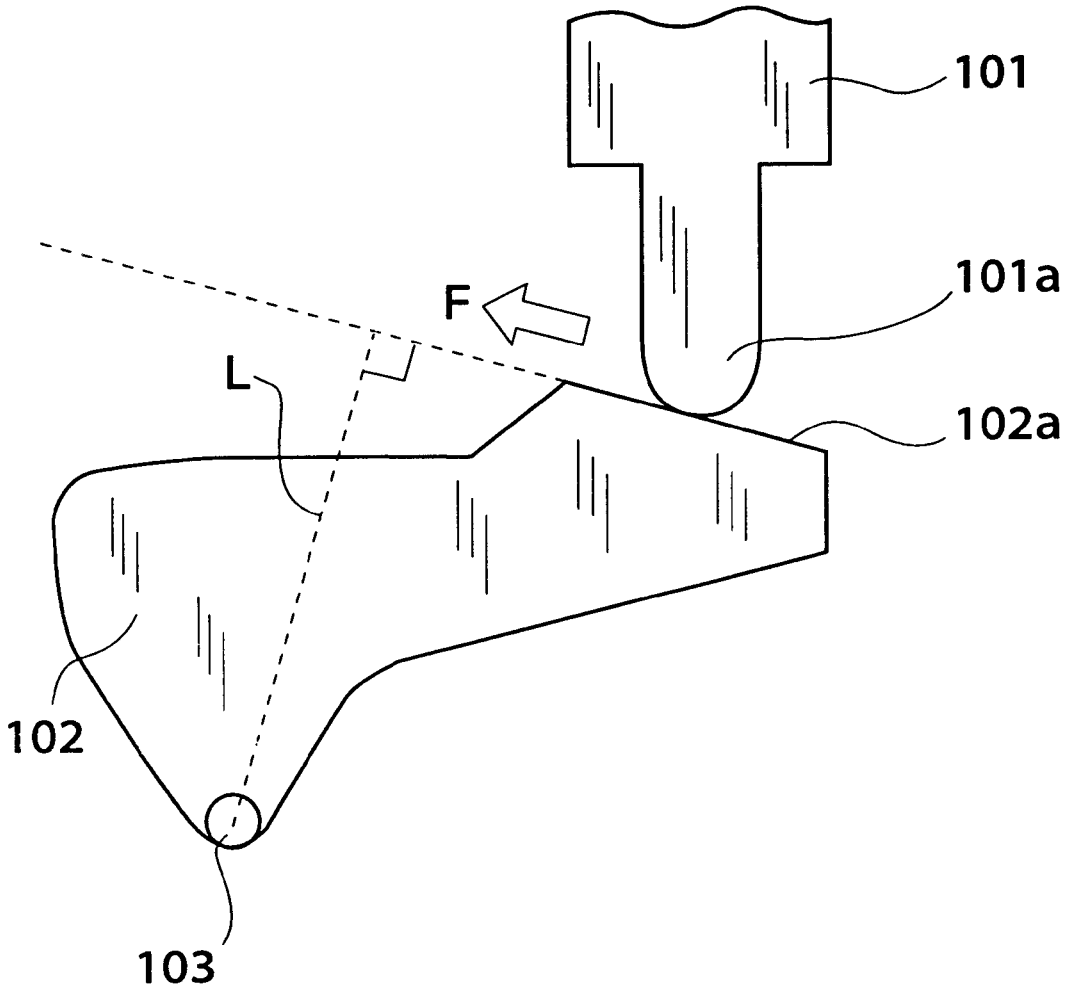
FIG.1 PRIOR ART
FIG. 1 is a schematic view showing the construction of a drive unit structure of a conventional keyboard assembly.
Figure 2:
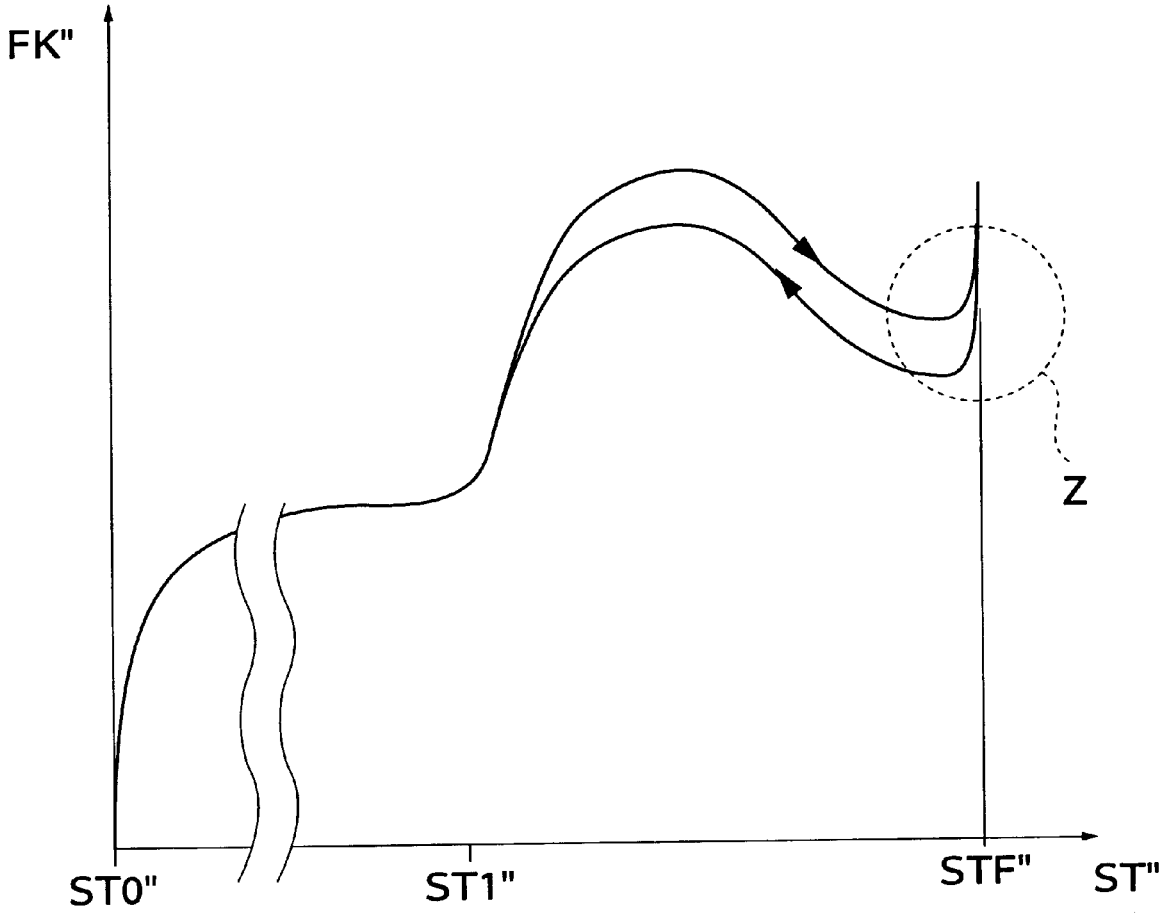
FIG.2 PRIOR ART
FIG. 2 is a graph showing a key depression resistance characteristic of an electronic keyboard musical instrument provided with the drive unit structure of the conventional keyboard assembly.
Figure 3A:
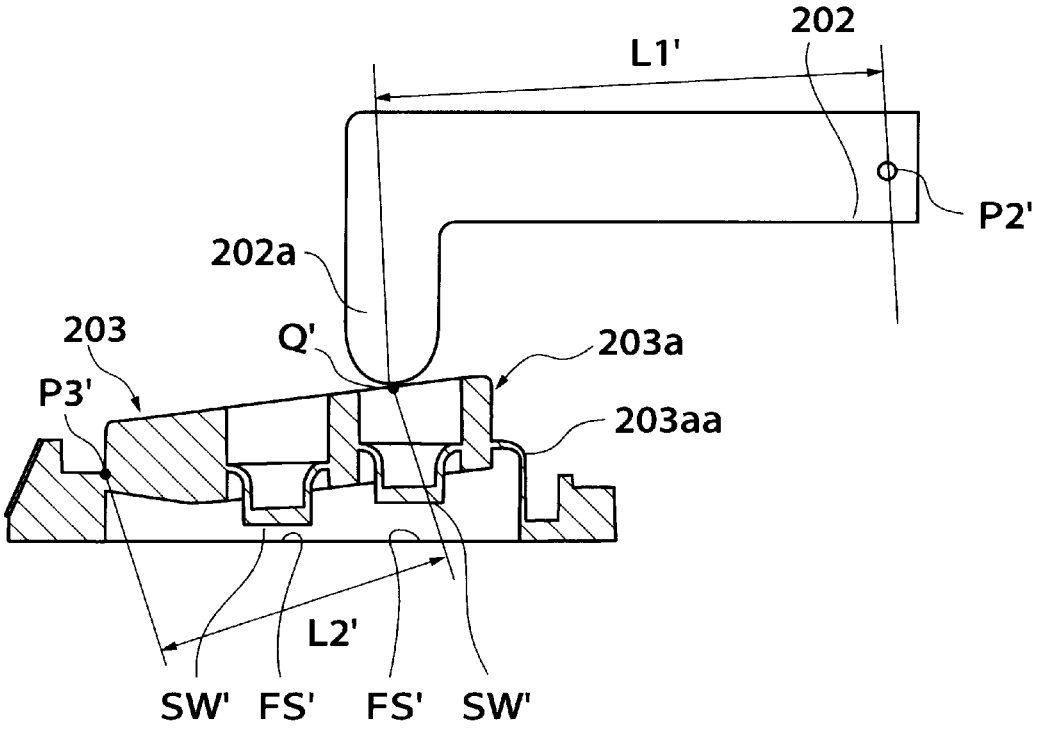
FIG.3A PRIOR ART
FIG. 3A is a fragmentary vertical sectional view showing a drive unit structure of a conventional keyboard assembly provided with a switch formed of a resilient material, with the drive unit structure at an initial stage of key depression stroke.
Figure 3B:
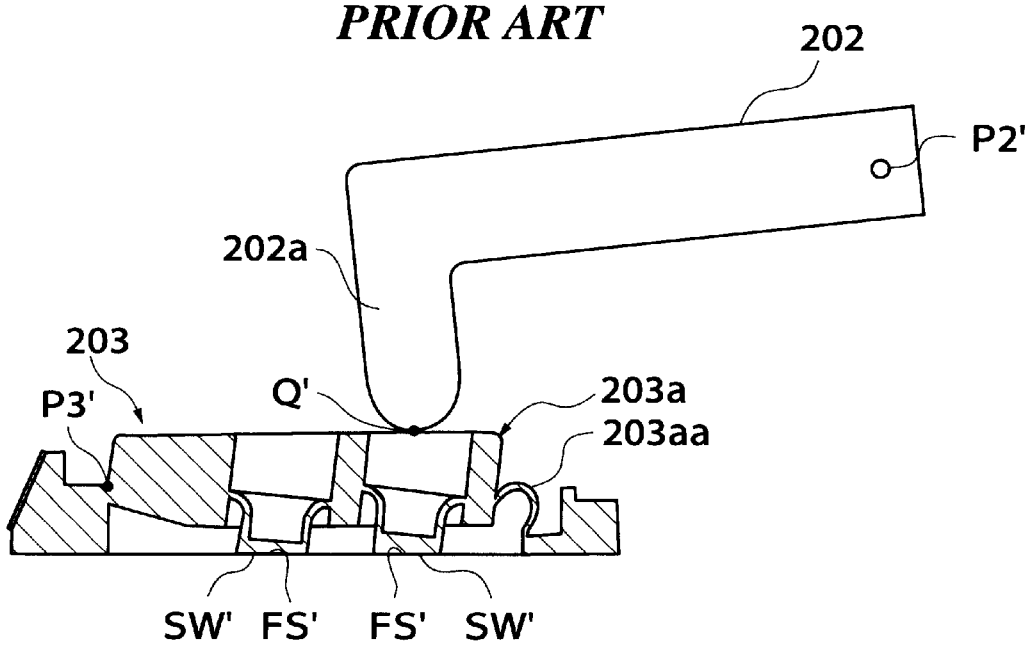
FIG.3B PRIOR ART
FIG. 3B shows the same at termination of the key depression stroke.

As mentioned before, in the prior art a key depression resistance characteristic as shown in FIG. 2 has been obtained, to thereby obtain an improved key depression feeling over the initial stage of key depression and the key position ST1". In the present embodiment, the expansion ratio EXP is progressively decreased over the key positions ST1 to STF so as to further improve the key depression resistance characteristic from that shown in FIG. 2 to that shown in FIG. 16. More specifically, the key depression resistance FK over the key positions ST1 to STF is closer to that of a genuine or natural grand piano, with respect to its ascending curve, and particularly, immediately before the lower limit position at the end of key depression the key depression resistance FK more gently rises as compared with that of FIG. 2, to thereby restrain vibration transmitted to the finger upon after touch and enable reproduction of a key depression feeling closer to that of the genuine grand piano. Besides, since the sliding surface 3*a*1 of the switch 3 is shaped in the form of a flat surface (with the curvature being zero), a linear expansion ratio EXP characteristic can be obtained to facilitate setting the key depression feeling.

In the present embodiment, the amount of movement of the point of contact Q (amounts of change as shown in FIGS. 14A to 14C) is set to a predetermined ratio (20%) with respect to the distance between the hammer fulcrum P2 and the switch fulcrum P3. The amount of movement should preferably be at least 10%. To this end, the axial lengths of the switch driving portion 2*e* of the hammer 2 and the sliding surface 3*a*1 of the switch 3 (lengths in the leftward and rightward direction as viewed in FIG. 5) should be set to sufficient lengths.

According to the third embodiment, the curvature 1/RS of the sliding surface 3*a*1 of the switch 3 is set to a value (=0) than the minimum curvature 1/RH of the tip surface 2*e*' of the switch driving portion 2*e*. Consequently, the expansion ratio EXP can be decreased as the key position shifts from ST1 to STF, while permitting the expansion ratio EXP to be freely set. As a result, the change characteristic of the key depression resistance FK can be improved with such a simple structural means, so as to obtain a key depression feeling very close to that of a grand piano. In addition, since the sliding surface 3*a*1 of the switch is designed to be flat (with the curvature being zero), free setting of the characteristic of the expansion ratio EXP is more facilitated.

A keyboard assembly with a drive unit structure according to a fourth embodiment of the invention has a function of electrically reproducing or generating musical tones of a pipe organ based upon a key-on signal or a like signal (not shown). Therefore, the drive unit structure according to the fourth embodiment is different from that according to the third embodiment in setting of the curvatures of the switch driving portion 2*e* of the hammer 2 and the sliding surface 3*a*1 of the switch 3. Setting of the distance between the point of contact Q and the hammer fulcrum P2 and the distance between the point of contact Q and the switch fulcrum P3 may be also changed from those of the third embodiment. The inertia of the hammer 2 may be suitably changed. Except for these, the fourth embodiment is identical with the third embodiment.

Figure 17:
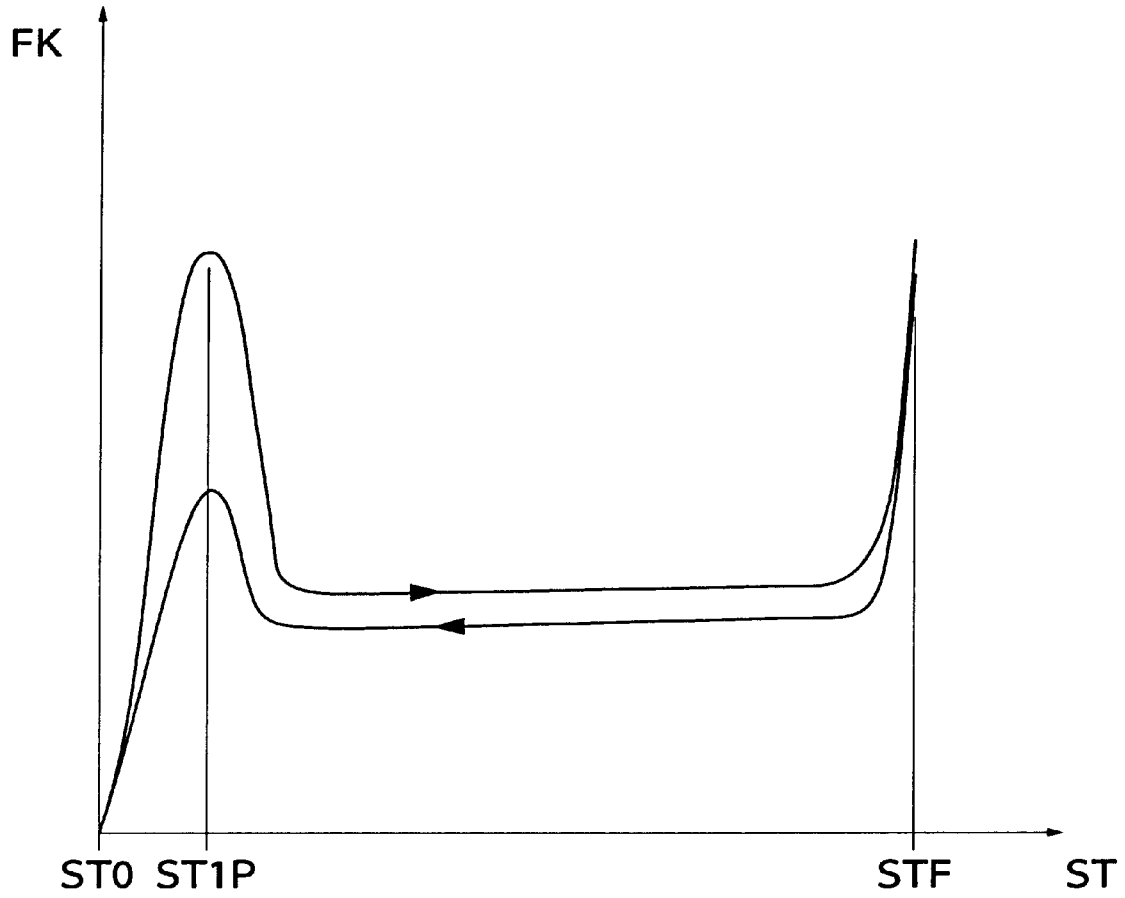
FIG.17 PRIOR ART
FIG. 17 is a graph showing a change in the key depression resistance of a natural pipe organ in general.

FIG. 17 is a graph showing a change in the key depression resistance of a natural pipe organ in general. The pipe organ has a characteristic that the key depression resistance FK suddenly rises at a key position ST1P due to opening and closing of a valve thereof, not shown.

Figure 18:
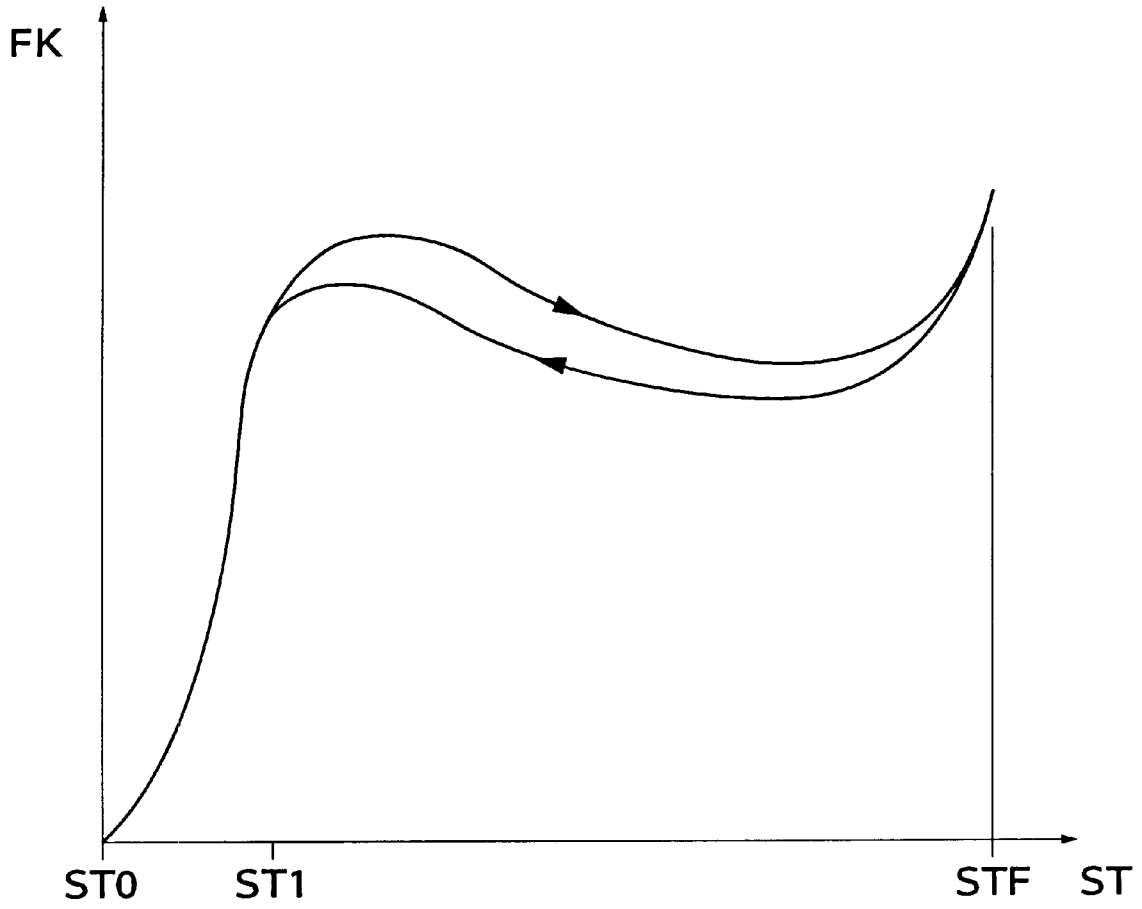
FIG.18 PRIOR ART
FIG. 18 is a change in the key depression resistance FK of a drive unit structure of a conventional keyboard assembly, exhibited when simulating a natural pipe organ.

FIG. 18 is a change in the key depression resistance FK of a drive unit structure of a conventional keyboard assembly, exhibited when simulating a natural pipe organ. In the drive unit structure of the conventional keyboard assembly, the point of contact Q does not change during the key depression stroke, and therefore the key depression resistance FK shows a characteristic as shown in FIG. 18.

Figure 19:
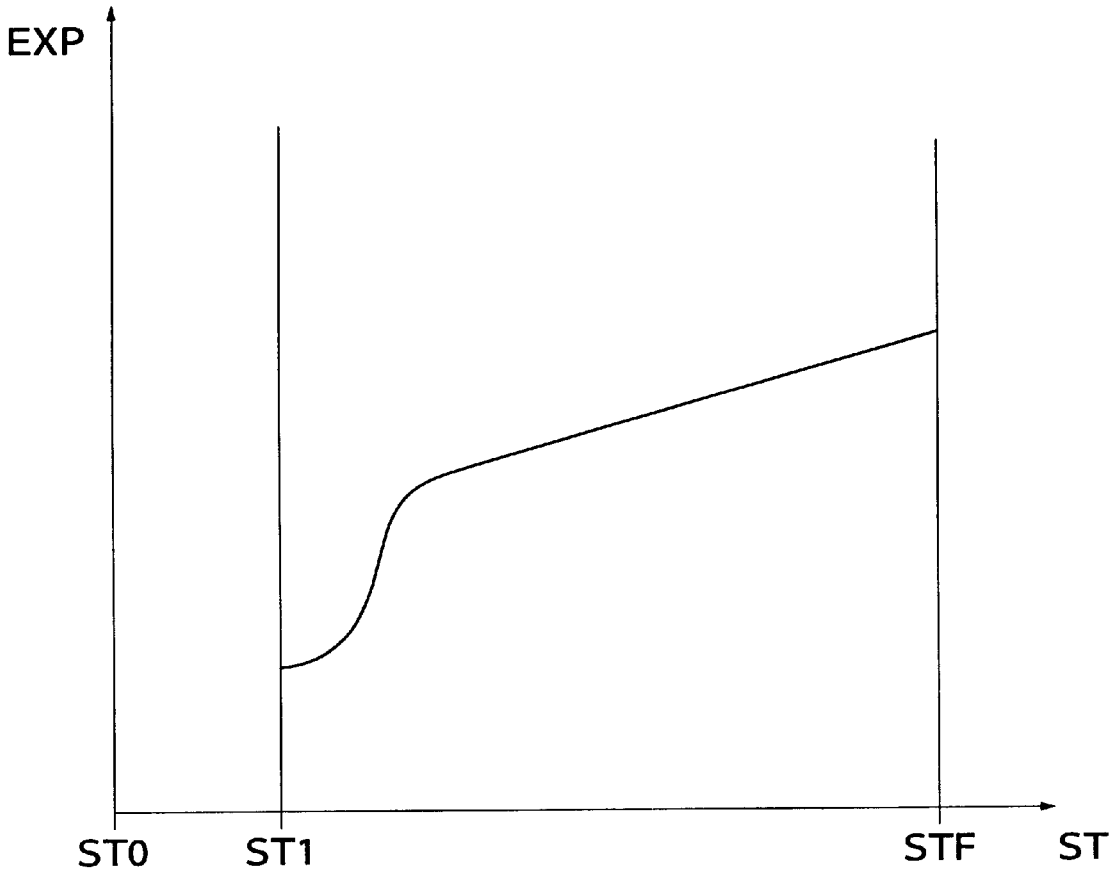
FIG. 19 is a graph showing a change in the expansion ratio EXP of a drive unit structure of a keyboard assembly according to a fourth embodiment of the invention.

FIG. 19 is a graph showing a change in the expansion ratio EXP of the drive unit structure of the keyboard assembly according to the fourth embodiment. In the present embodiment, the expansion ratio EXP over the key positions ST1 to STF is set as shown in FIG. 19. More specifically, the expansion ratio EXP is set to a small value immediately after the key position ST1, and thereafter is set to progressively increased values, so as to realize a feeling of key depression close to that of a natural pipe organ.

The above described third and fourth embodiments may be applied to realize a feeling of key depression of musical instruments other than the grand piano and the pipe organ.

The switch 3 may be a type having only a single movable contact.

A drive unit structure according to a fifth embodiment of the invention has an improved accuracy of detection of key depression by setting the expansion ratio EXP according to moving speeds of movable contacts of the switch 3.

Figure 20:
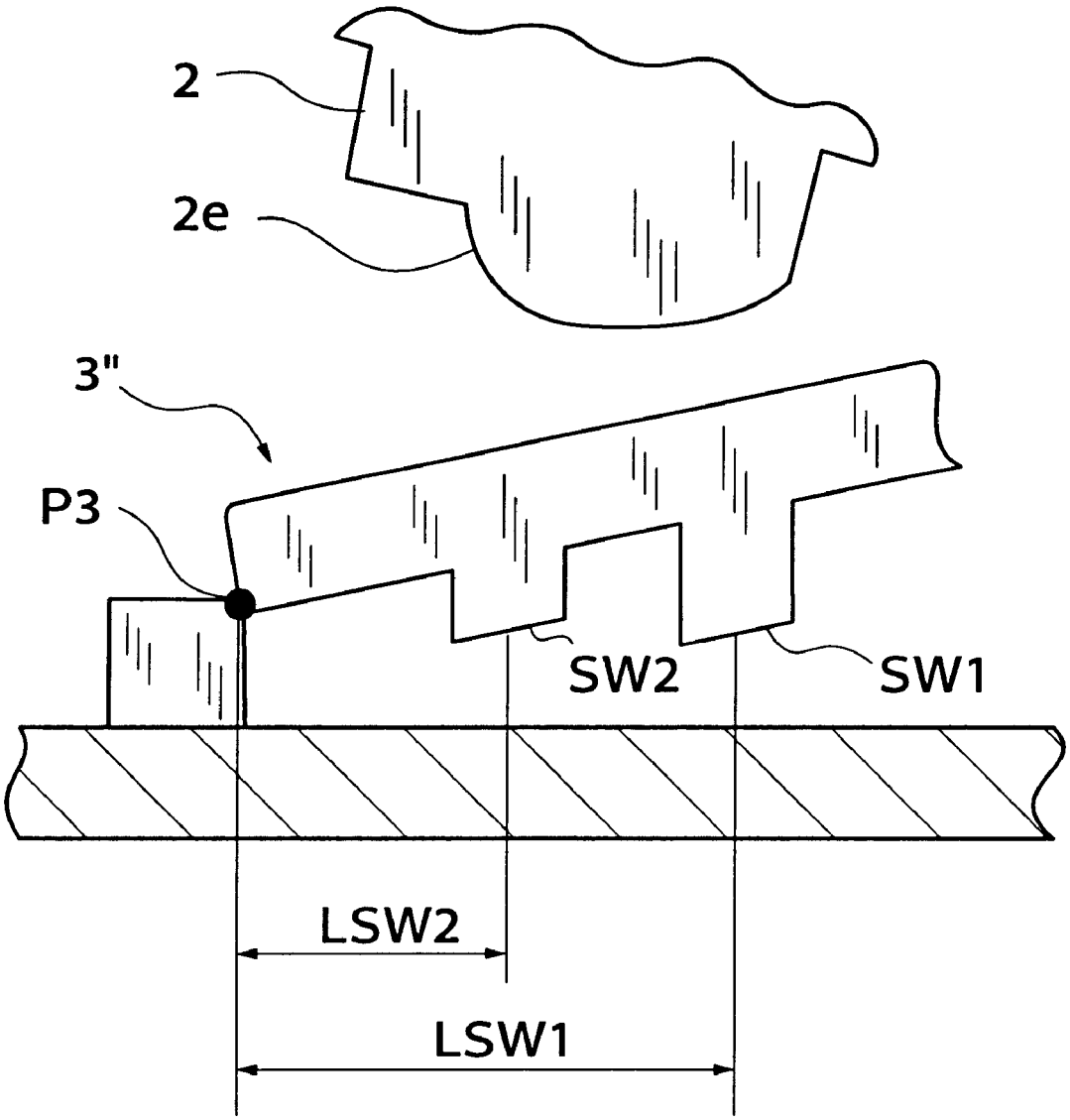
FIG. 20 is a graph showing a drive unit structure of a keyboard assembly according to a fifth embodiment of the invention.

FIG. 20 is a graph showing the drive unit structure according to the fifth embodiment. The drive unit structure according to the present embodiment includes a switch 3" which has a first movable contact SW1, and a second movable contact SW2. The other component elements of the switch and the hammer 2 are identical in construction with those of the third and fourth embodiments described above.

When the hammer 2 drives the switch 3", first, the first movable contact SW1 urgingly contacts the fixed contact to turn the switch on (hereinafter referred to as "the first make"), and then the second movable contact SW2 similarly contact the fixed contact to again turn the switch on (hereinafter referred to as "the second make") If the drive unit structure is fabricated under normal manufacturing conditions, vertical positions of tips of the movable contacts SW1, SW2 have almost the same manufacturing tolerances. Variations in timing of the make are determined by the manufacturing tolerances as well as the moving speeds of the movable contacts SW1, SW2 assumed upon make thereof (the detection errors are larger as the moving speeds upon the make are lower). If the key depression resistance FK were almost constant as in the conventional electronic keyboard musical instrument, the switch 3" would pivotally move at a constant speed so that the moving speed of an inner one of the movable contacts SW1, SW2 is slower than that of the other. Therefore, insofar as the manufacturing tolerances are the same between the first and second movable contacts, the inner movable contact SW2 which has a lower moving speed has a larger detection error than the movable contact SW1.

According to the fifth embodiment, by suitably setting the expansion ratio EXP. the movable contacts SW, SW2 have almost the same moving speed. More specifically, it is so set that the expansion ratio EXP progressively increases after the first make, and upon the second make,.assumes at least LSW1/LSW2 times as large as the value assumed upon the first make, provided that the distance between the switch fulcrum P3 and the first movable contact SW1 is represented by LSW1, and the distance between the switch fulcrum P3 and the second movable contact SW2 by LSW2. As the expansion ratio EXP is larger, the key depression resistance FK is smaller and accordingly the moving speed upon the second make is higher.

By setting the expansion ratio EXP as above, variations in detection error of the key depressing operation due to the manufacturing tolerances can be eliminated between the first and second movable contacts, so that the detection error does not depend upon the movable contact SW2. As a result, the accuracy of detection of the key depressing operation, particularly the accuracy of detection of the key velocity, can be improved. If the error of detection of the key velocity by the movable contacts SW1, SW2 is large, the player has a degraded feeling of key depression, particularly that of after touch. Therefore, the present embodiment also contributes to improvement of the key depression feeling.

According to the fifth embodiment, the accuracy of detection of the key depressing operation and hence the feeling of key depression can be improved by suitably setting the expansion ratio EXP. The present embodiment may be combined with the first and/or second embodiment to easily realize a feeling of key depression of a genuine or natural grand piano, pipe organ, or a like musical instrument.

The fifth embodiment may be applied to a drive unit structure of a keyboard assembly which has a switch having a plurality of movable contacts. The switch 3 may be a type having one or more movable contacts at either side of the switch fulcrum P3.

The above described third to fifth embodiments are intended to improve the feeling of touch of an acoustic musical instrument and/or improve the accuracy of detection of key depressing operation by setting the expansion ratio EXP and the positional relationship between the hammer fulcrum P2 and the switch fulcrum P3. However, they may have other applications. For example, they may be applied to cope with a phenomenon that the key depression resistance temporarily rises whenever each of a plurality of movable contacts is made. That is,m, in such a case, the rise characteristic is analyzed, and the expansion ratio EXP may be suitably set so as to remove a rise component of the key depression resistance which is detrimental to the feeling of key depression, to thereby further improve the feeling of key depression of an electronic musical instrument.

Although in the third to fifth embodiments the tip surface 2*e*, of the switch driving portion 2*e* of the hammer 2 is shaped in the form of a convex and the sliding surface 3*a*1 of the switch 3 in the form of a flat surface, this is not limitative, but these surfaces may be shaped in other ways insofar as the above-mentioned combination of curvatures is maintained. For example, they are both shaped in the form of a convex, or one surface is shaped in the form of a convex and the other in the form of a concave, though the shaping of one surface in the form of a flat surface provides the above-mentioned advantage of facilitation of setting of the expansion ratio EXP.

Although in the third to fifth embodiments the point of contact Q is located between the hammer fulcrum P2 and the switch fulcrum P3, this is not limitative, but, for example, it may be located on a side of either one of these fulcrums remote from the other.

Further, although in the third to fifth embodiments the expansion ratio EXP can be changed only in dependence on the relationship between the hammer 2 and the switch 3, this is not limitative, but, for example, it may be changed in dependence on the relationship between the key 1 (hammer driving portion 1*b*) and the hammer 2 (sliding surface 2*d*), or it may be changed in dependence on both the relationship between the hammer 2 and the switch 3 and the relationship between the key 1 and the hammer 2.

Further, an actuator and/or a driven member dedicated to adjustment of the feeling of key depression may be provided.

The present invention is not limited to the drive unit structure for key depressing operation, but may be applied to various drive units of a keyboard assembly.

What is claimed is:

1. A drive unit structure for a keyboard assembly, comprising:

a driven member having a flat sliding surface and pivotable about a fulcrum thereof; and an actuator disposed for sliding contact with said flat sliding surface of said driven member to pivotally drive said driven member, wherein said fulcrum of said driven member lies in a plane including said flat sliding surface of said driven member.

2. A drive unit structure as claimed in claim 1, including a key and a mass member for imparting inertia to an operation of depressing said key, and wherein said driven member comprises said mass member, and said actuator comprises said key, said mass member being disposed to bias said key to a non-depressed position of said key, and to be pivotally driven in response to said operation of depressing said key to thereby impart inertia to said operation of depressing said key.

3. A drive unit structure as claimed in claim 1, including a key, and wherein said driven member comprises a key switch for detecting an operation of depressing said key, and said actuator comprises a mass member for imparting inertia to said operation of depressing said key, said mass member being disposed to bias said key to a non-depressed position of said key, and to be pivotally driven in response to said operation of depressing said key to thereby impart inertia to said operation of depressing said key.

4. A drive unit structure for a keyboard assembly, comprising:

a driven member having a flat sliding surface and pivotable about a first fulcrum thereof; and an actuator pivotable about a second fulcrum thereof and disposed for sliding contact with said flat sliding surface of said driven member to pivotally drive said driven member, wherein a plane including said flat sliding surface of said driven member passes said second fulcrum during a stroke of pivotally driving said driven member by said actuator.

5. A drive unit structure as claimed in claim 4, including a key, and a switch board, said actuator being disposed to pivotally move in response to an operation of depressing said key, said driven member comprising a key switch disposed for contact with said switch board to thereby detect the operation of depressing the key, and wherein a plane including said flat sliding surface of said driven member passes said second fulcrum when said key switch is in contact with said switch board.

6. A drive unit structure as claimed in claim 4, including a key, said actuator being disposed to pivotally move in response to an operation of depressing said key, and wherein a plane including said flat sliding surface of said driven member passes said second fulcrum when said key reaches a lower limit position thereof at an end of a stroke of depressing said key.

7. A drive unit structure as claimed in claim 4, wherein said first fulcrum lies in a plane including said flat sliding surface of said driven member.

8. A drive unit structure as claimed in claim 5, wherein said first fulcrum lies in a plane including said flat sliding surface of said driven member.

9. A drive unit structure as claimed in claim 6, wherein said first fulcrum lies in a plane including said flat sliding surface of said driven member.

10. A drive unit structure for a keyboard assembly, comprising:

a driven member having a flat sliding surface and pivotable about a first fulcrum thereof; and an actuator pivotable about a second fulcrum thereof and disposed for sliding contact with said flat sliding surface of said driven member to pivotally drive said driven member, wherein a point of contact at which said actuator contacts said driven member traverses a segment extending through said first fulcrum and said second fulcrum during a stroke of pivotally driving said driven member by said actuator.

11. A drive unit structure as claimed in claim 10, including a key, and a switch board, said actuator being disposed to pivotally move in response to an operation of depressing said key, said driven member comprising a key switch disposed for contact with said switch board to thereby detect the operation of depressing the key, and wherein said point of contact at which said actuator contacts said driven member lies on said segment extending through said first fulcrum and said second fulcrum when said key switch is in contact with said switch board.

12. A drive unit structure as claimed in claim 10, including a key, said actuator being disposed to pivotally move in response to an operation of depressing said key, and wherein said point of contact at which said actuator contacts said driven member lies on said segment extending through said first fulcrum and said second fulcrum when said key reaches a lower limit position thereof at an end of a stroke of depressing said key.

13. A drive unit structure as claimed in claim 10, wherein said point of contact at which said actuator contacts said driven member depicts a locus intersecting a portion of said segment extending between said first fulcrum and said second fulcrum.

14. A drive unit structure as claimed in claim 11, wherein said point of contact at which said actuator contacts said driven member depicts a locus intersecting a portion of said segment extending between said first fulcrum and said second fulcrum.

15. A drive unit structure for a keyboard assembly, comprising:

a driven member pivotable about a first fulcrum thereof; and an actuator pivotable about a second fulcrum thereof and having a surface thereof disposed for sliding contact with a surface of said driven member to pivotally drive said driven member;

wherein one of said surface of said actuator and said surface of said driven member is shaped in a form of a convex, and the other of said surface of said actuator and said surface of said driven member is a curved surface and has a curvature smaller than a minimum curvature of said one of said surface of said actuator and said surface of said driven member.

16. A drive unit structure as claimed in claim 15, wherein said one and the other of said surface of said actuator and said surface of said driven member each have a curvature thereof set such that an amount of movement of a point of contact at which said actuator contacts said driven member is equal to a predetermined ratio multiplied by a distance between said first fulcrum and said second fulcrum.

17. A drive unit structure as claimed in claim 15, including a key, and a switch board, said actuator being disposed to pivotally move in response to an operation of depressing said key, said driven member comprising a key switch disposed for contact with said switch board to thereby detect the operation of depressing the key.

18. A drive unit structure as claimed in claim 16, including a key, and a switch board, said actuator being disposed to pivotally move in response to an operation of depressing said key, said driven member comprising a key switch disposed for contact with said switch board to thereby detect the operation of depressing the key.

19. A drive unit structure for a keyboard assembly, comprising:

a driven member having a flat sliding surface and pivotable about a first fulcrum thereof, said first fulcrum lying in a plane including said flat sliding surface of said driven member; and an actuator pivotable about a second fulcrum thereof and disposed for sliding contact with said flat sliding surface of said driven member to pivotally drive said driven member;

wherein a plane including said flat sliding surface of said driven member passes said second fulcrum during a stroke of pivotally driving said driven member by said actuator.

20. A drive unit structure for a keyboard assembly, comprising:

a driven member having a flat sliding surface and pivotable about a first fulcrum thereof, said first fulcrum lying in a plane including said flat sliding surface of said driven member;

an actuator pivotable about a second fulcrum thereof and disposed for sliding contact with said flat sliding surface of said driven member to pivotally drive said driven member;

a key; and a switch board, said actuator being disposed to pivotally move in response to an operation of depressing said key, said driven member comprising a key switch disposed for contact with said switch board to thereby detect the operation of depressing the key, wherein a plane including said flat sliding surface of said driven member passes said second fulcrum, during a stroke of pivotally driving said driven member by said actuator, when said key switch is in contact with said switch board.

21. A drive unit structure for a keyboard assembly, comprising:

a driven member having a flat sliding surface and pivotable about a first fulcrum thereof;

an actuator pivotable about a second fulcrum thereof and disposed for sliding contact with said flat sliding surface of said driven member to pivotally drive said driven member; and a key, said actuator being disposed to pivotally move in response to an operation of depressing said key, and wherein a plane including said flat sliding surface of said driven member passes said second fulcrum, during a stroke of pivotally driving said driven member by said actuator, when said key reaches a lower limit position thereof at an end of a stroke of depressing said key.

* * * * *